US009937739B2

(12) United States Patent
Nakamura

(10) Patent No.: US 9,937,739 B2
(45) Date of Patent: Apr. 10, 2018

(54) INKJET PRINTER

(71) Applicant: RISO KAGAKU CORPORATION, Tokyo (JP)

(72) Inventor: Hiroyuki Nakamura, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/046,948

(22) Filed: Feb. 18, 2016

(65) Prior Publication Data

US 2016/0288554 A1 Oct. 6, 2016

(30) Foreign Application Priority Data

Mar. 31, 2015 (JP) ..... 2015-072212

(51) Int. Cl.

| | |
|---|---|
| ***B41J 2/48*** | (2006.01) |
| ***B41J 29/377*** | (2006.01) |
| ***B41J 2/175*** | (2006.01) |
| ***B41J 2/18*** | (2006.01) |
| ***B41J 29/38*** | (2006.01) |
| ***B41J 2/21*** | (2006.01) |

(52) U.S. Cl.
CPC ..... *B41J 29/377* (2013.01); *B41J 2/175* (2013.01); *B41J 2/18* (2013.01); *B41J 2/2146* (2013.01); *B41J 29/38* (2013.01)

(58) Field of Classification Search
CPC combination set(s) only.
See application file for complete search history.

(56) References Cited

U.S. PATENT DOCUMENTS 4,704,620 A * 11/1987 Ichihashi ..... B41J 29/377 118/302
6,166,828 A * 12/2000 Yamada ..... B41J 2/16523 347/15
6,517,182 B1 * 2/2003 Scardovi ..... B41J 2/04553 347/19
7,040,732 B2 * 5/2006 Dudek ..... B41J 2/1755 347/102
8,888,216 B2 * 11/2014 Ito ..... B41J 29/38 347/10

(Continued)

FOREIGN PATENT DOCUMENTS

EP 2639071 A1 * 9/2013 ..... B41J 2/04581
JP 2010-264752 11/2010

*Primary Examiner* — Matthew Luu
*Assistant Examiner* — Lily Kemathe
(74) *Attorney, Agent, or Firm* — Greenblum & Bernstein, P.L.C.

(57) ABSTRACT

An inkjet printer includes a conveyer, a plurality of inkjet heads, a head cooler configured to generate cooling air and cool the plurality of inkjet heads by the generated cooling air, and a controller. The controller is configured to drive the plurality of inkjet heads to perform non-ejection drive on at least one of lines which involve no ink ejection, the non-ejection drive being driving of the plurality of inkjet heads to such a degree as to eject no ink. The controller is configured to determine a non-ejection drive ratio for each of the plurality of inkjet heads in accordance with a position of each of the plurality of inkjet heads, the non-ejection drive ratio being a ratio of lines on which the controller performs the non-ejection drive to the lines which involve no ink ejection.

16 Claims, 19 Drawing Sheets

(56) References Cited

U.S. PATENT DOCUMENTS

| | | | | |
|---|---|---|---|---|
| 8,939,529 | B2 * | 1/2015 | Shimada | B41J 11/002 347/101 |
| 9,126,405 | B2 * | 9/2015 | Sugiura | B41J 2/072 |
| 9,409,430 | B2 * | 8/2016 | Arimura | B41J 29/377 |
| 2002/0101472 | A1 * | 8/2002 | Tsuboi | B41J 2/16526 347/35 |
| 2010/0066785 | A1 * | 3/2010 | Yamada | B41J 2/175 347/18 |
| 2011/0085004 | A1 * | 4/2011 | Bansyo | B41J 2/175 347/17 |
| 2014/0009534 | A1 * | 1/2014 | Yamamoto | B41J 2/16526 347/35 |
| 2014/0292887 | A1 * | 10/2014 | Sugiura | B41J 2/072 347/18 |

* cited by examiner

INKJET PRINTER

CROSS REFERENCE TO RELATED APPLICATION

This application is based upon and claims the benefit of priority from the prior Japanese Patent Application No. 2015-072212, filed on Mar. 31, 2015, the entire contents of which are incorporated herein by reference.

BACKGROUND

1. Technical Field

The disclosure relates to an inkjet printer configured to perform printing by ejecting an ink from inkjet heads.

2. Related Art

In an inkjet printer, inkjet heads generate heat as a result of ink ejection. The temperature increase by the heat generation of the inkjet heads may cause failure of the inkjet heads and the like. For this reason, it is necessary to cool the inkjet heads to suppress the temperature increase.

To do so, Japanese Unexamined Patent Application Publication No. 2010-264752 proposes a technique of cooling inkjet heads by sending cooling air to the inkjet heads means of fans.

SUMMARY

In the case of such an inkjet printer configured to cool a plurality of inkjet heads with cooling air by means of a fan, the inkjet heads are cooled to different degrees depending on their positions, and some inkjet head may be excessively cooled. For example, the closest inkjet head to the fan may be excessively cooled.

The lower the ink temperature and the higher the ink viscosity, the more ink mist is generated in ejection of the ink from an inkjet head. Then, if an inkjet head is excessively cooled, the ink temperature at that inkjet head may possibly be excessively decreased and resultantly increase the ink mist. The ink mist causes contamination of the inside of the machine and printed products.

An object of the disclosure is to provide an inkjet printer capable of reducing ink mist.

An inkjet printer in accordance with some embodiments includes: a conveyer configured to convey a print medium; a plurality of inkjet heads configured to perform ink ejection per line of an image onto the print medium conveyed by the conveyer; a head cooler configured to generate cooling air and cool the plurality of inkjet heads by the generated cooling air; and a controller configured to drive the plurality of inkjet heads to perform non-ejection drive on at least one of lines which involve no ink ejection, the non-election drive being driving of the plurality of inkjet heads to such a degree as to eject no ink. The controller is configured to determine a non-ejection drive ratio for each of the plurality of inkjet heads in accordance with a position of each of the plurality of inkjet heads, the non-ejection drive ratio being a ratio of lines on which the controller performs the non-ejection drive to the lines which involve no ink ejection.

According to the configuration described above, the controller determines the non-ejection drive ratio for each inkjet head in accordance with the position of the inkjet head. In this way, the inkjet head can be prevented from being excessively cooled, and the ink temperature can therefore be prevented from excessively decreased. As a result, the ink mist can be reduced.

The controller may be configured to drive the plurality of inkjet heads to perform, for each first number of lines which involve no ink ejection, the non-ejection drive on a second number of lines of the first number of lines, the second number corresponding to the determined non-ejection drive ratio.

According to the configuration described above, the lines on which to perform the non-ejection drive can be spread. As a result, the decrease in temperature of the inkjet head can be further suppressed, and the ink mist can therefore be further reduced.

The controller may be configured to adjust the non-ejection drive ratio based on a print coverage rate at each of the plurality of inkjet heads.

According to the configuration described above, the non-ejection drive ratio is adjusted based on the print coverage rate. In this way, the temperature of the inkjet head can be maintained at more appropriate temperature, and the ink mist can therefore be further reduced.

The controller may be configured to adjust the non-ejection drive ratio based on an ink temperature at each of the plurality of inkjet heads.

According to the configuration described above, the non-ejection drive ratio is adjusted based on the ink temperature at the inkjet head. In this way, the temperature of the inkjet head can be maintained at more appropriate temperature, and the ink mist can therefore be further reduced.

The controller may be configured to adjust the non-ejection drive ratio based on a distance between an upper surface of the print medium and an ink ejection surface of each of the plurality of inkjet heads.

According to the configuration described above, the non-ejection drive ratio is adjusted based on the distance between the ink ejection surface of the inkjet head and the upper surface of the print medium, which affects the degree of generation of the ink mist. In this way, the ink mist can be further reduced.

The conveyer may be configured to convey the print medium while attracting and holding the print medium by air suction. The controller may be configured to adjust the non-election drive ratio for one of the plurality of inkjet heads located at a position coinciding with an end portion of the print medium in a direction perpendicular to a direction of conveyance of the print medium by the conveyer.

According to the configuration described above, the non-ejection drive ratio is adjusted for the inkjet head at the position coinciding with the end portion of the print medium in the direction perpendicular to the direction of conveyance, at which the ink mist tends to be generated more. In this way, the ink mist can be further reduced.

DETAILED DESCRIPTION

Figure 1:
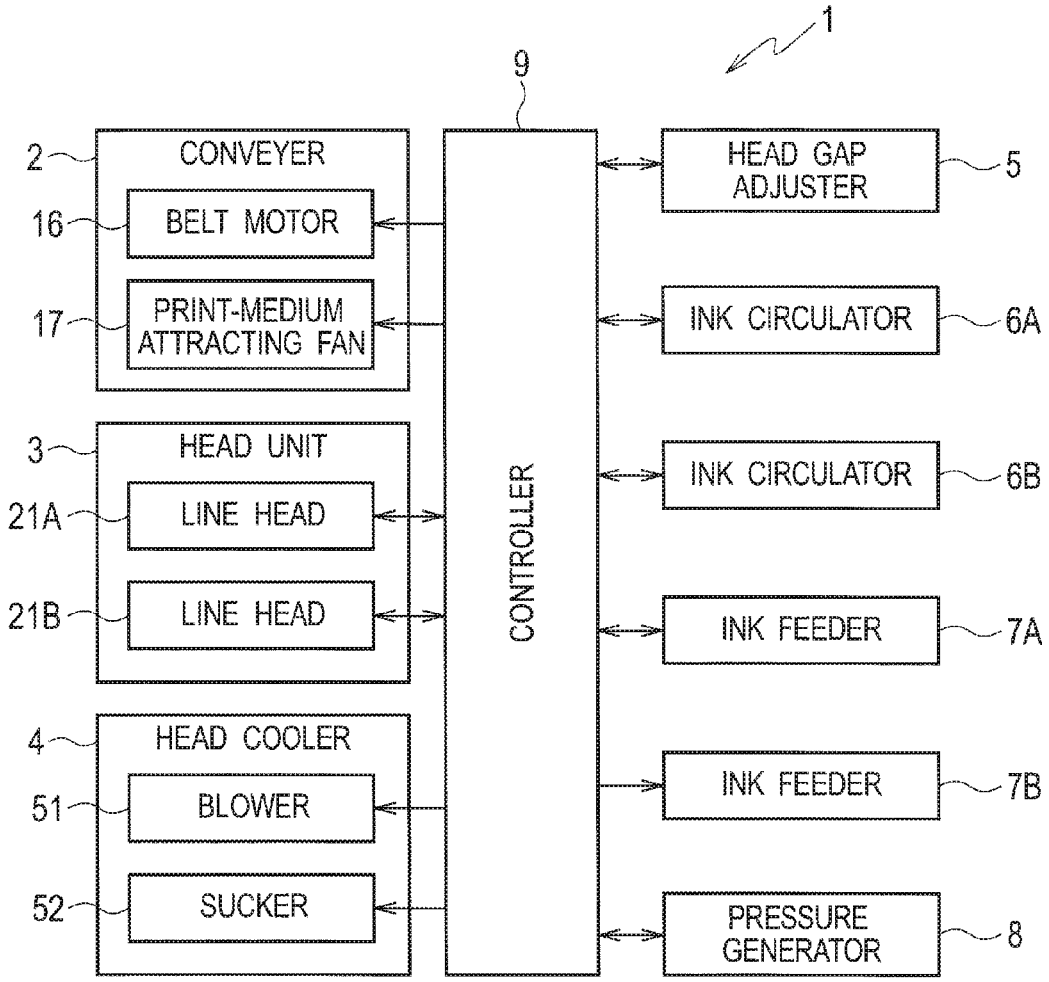
FIG. 1 is a block diagram illustrating the configuration of an inkjet printer according to a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

First Embodiment

Figure 2:
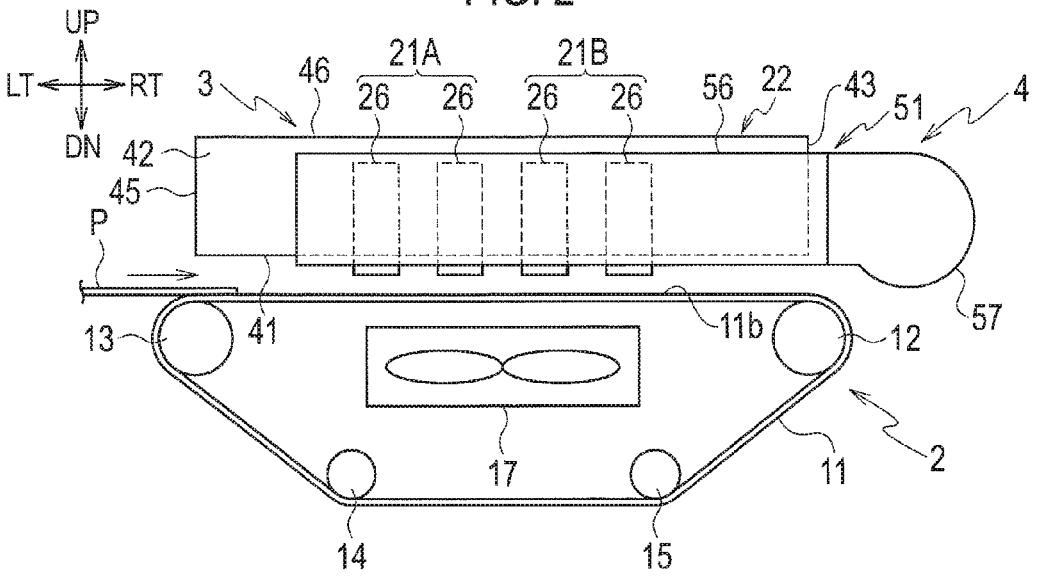
FIG. 2 is a schematic configuration diagram of conveyer, a head unit, and a head cooler of the inkjet printer, which is illustrated in FIG. 1.
Figure 3:
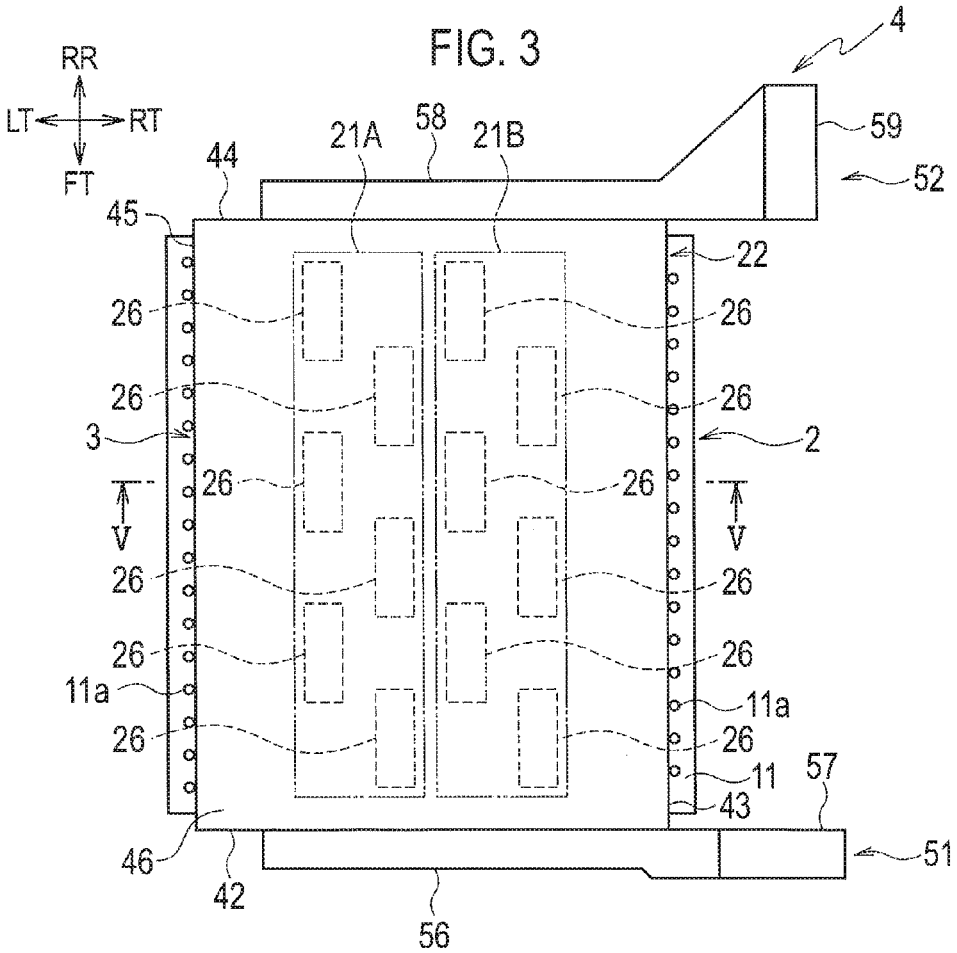
FIG. 3 is a plan view of the conveyer, the head unit, and the head cooler of the inkjet printer, which is illustrated in FIG. 1.
Figure 4:
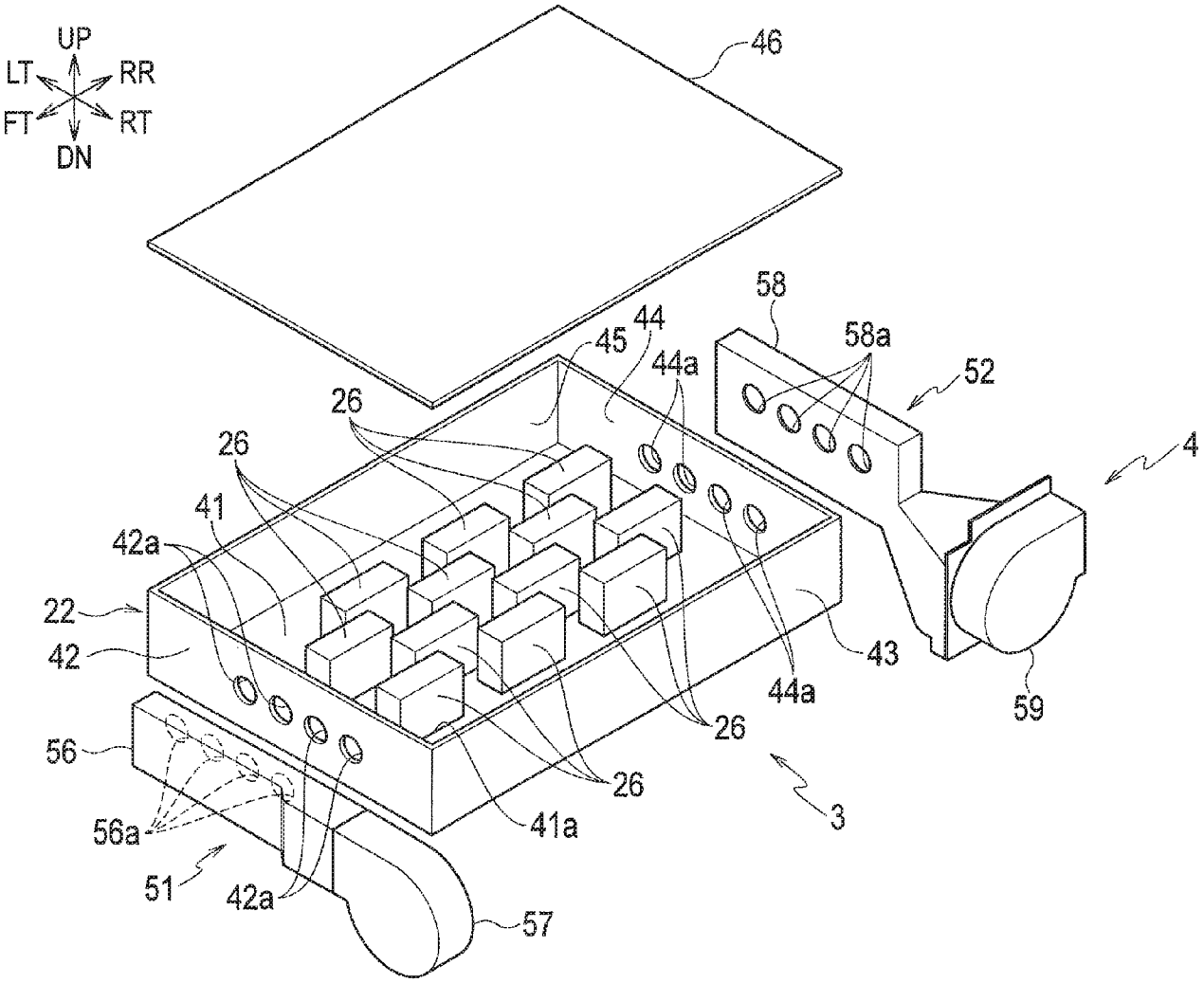
FIG. 4 is an exploded perspective view of the head unit and the head cooler of the inkjet printer, which is illustrated in FIG. 1.
Figure 5:
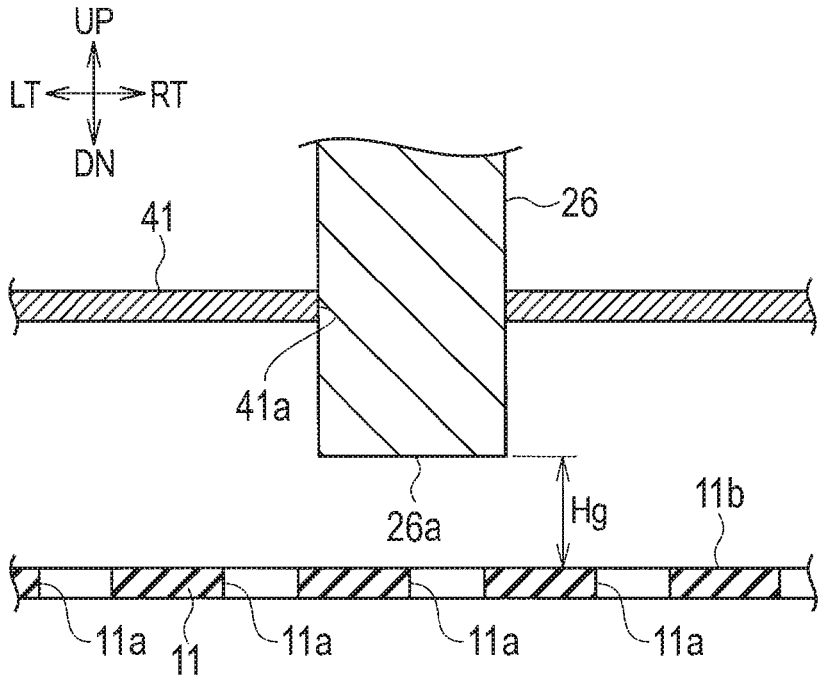
FIG. 5 is a partially-enlarged cross-sectional view of the conveyer and the head unit taken along line V-V in FIG. 3.
Figure 6:
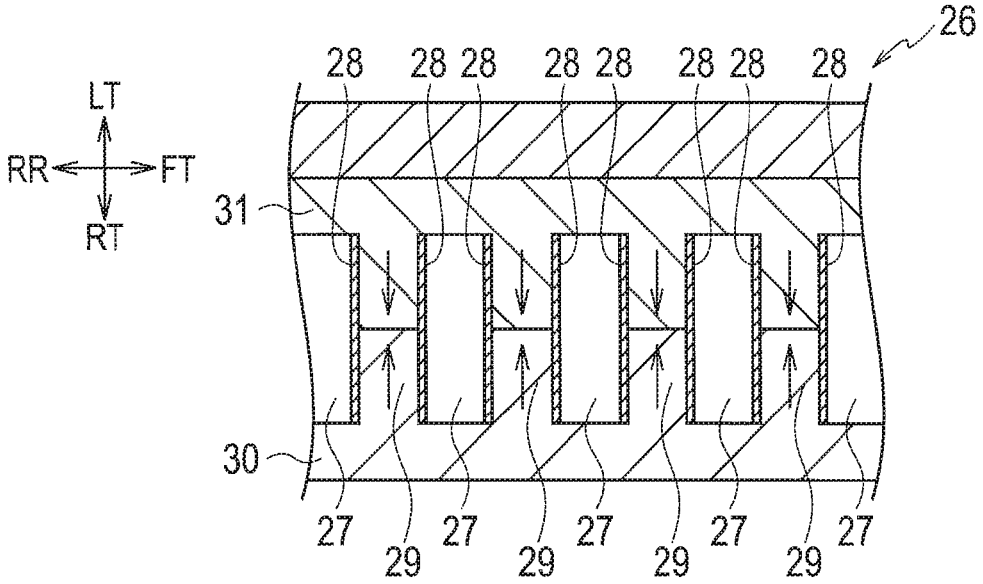
FIG. 6 is a partial cross-sectional view of an inkjet head taken along a horizontal plane.
Figure 7:
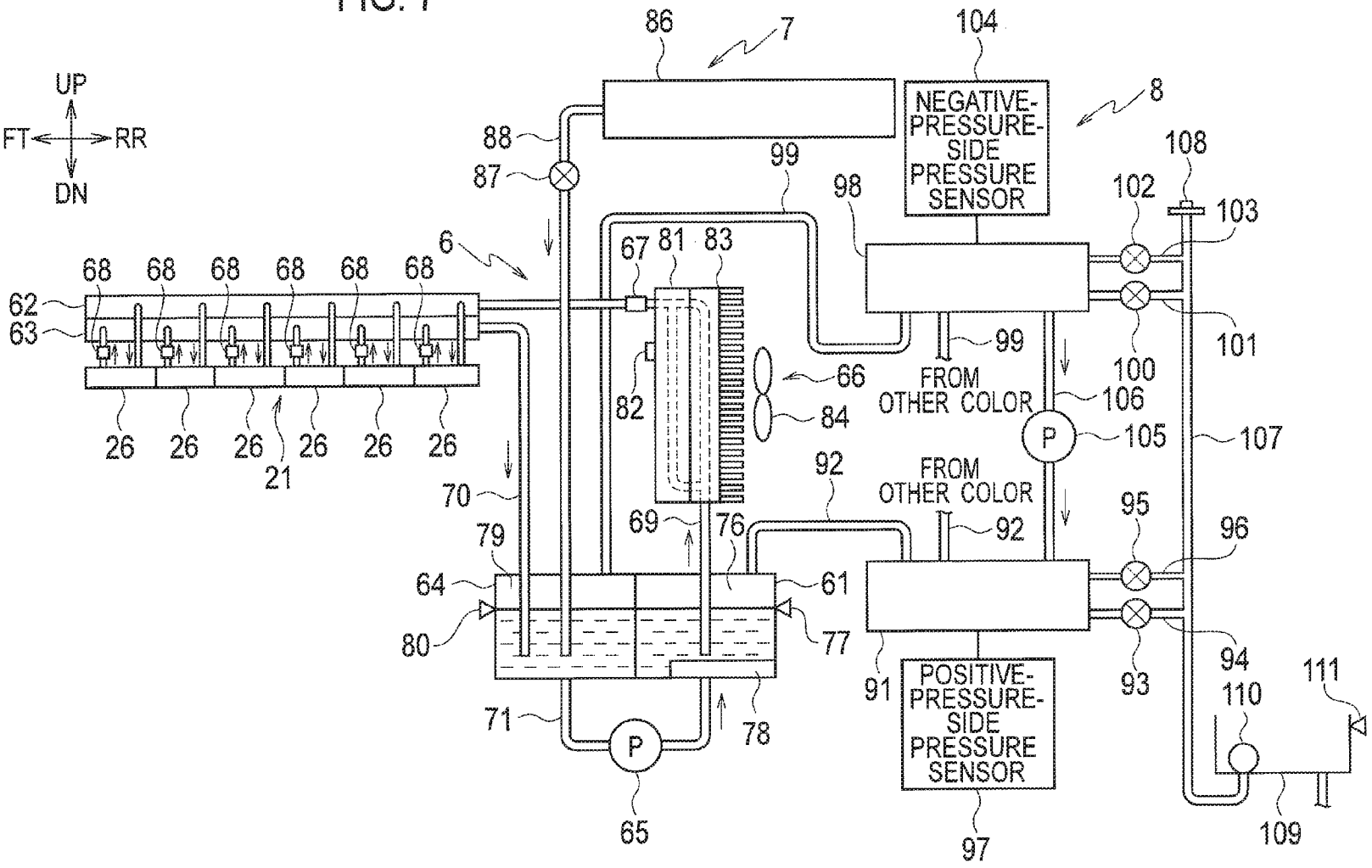
FIG. 7 is a schematic configuration diagram of an ink circulator, an ink feeder, and a pressure generator of the inkjet printer, which is illustrated in FIG. 1.
Figure 8:
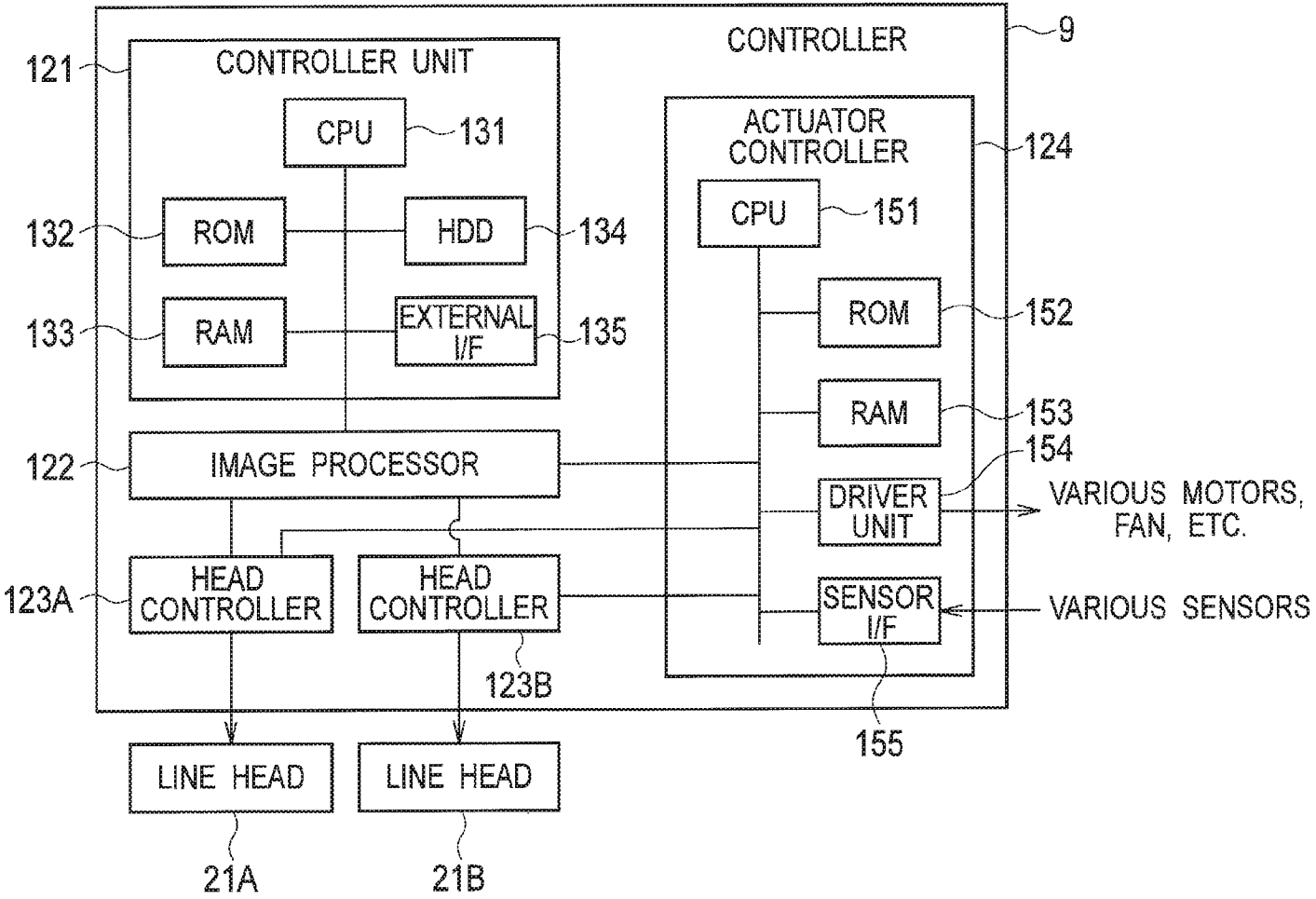
FIG. 8 is a block diagram illustrating the configuration of a controller of the inkjet printer, which is illustrated in FIG. 1.
Figure 9:
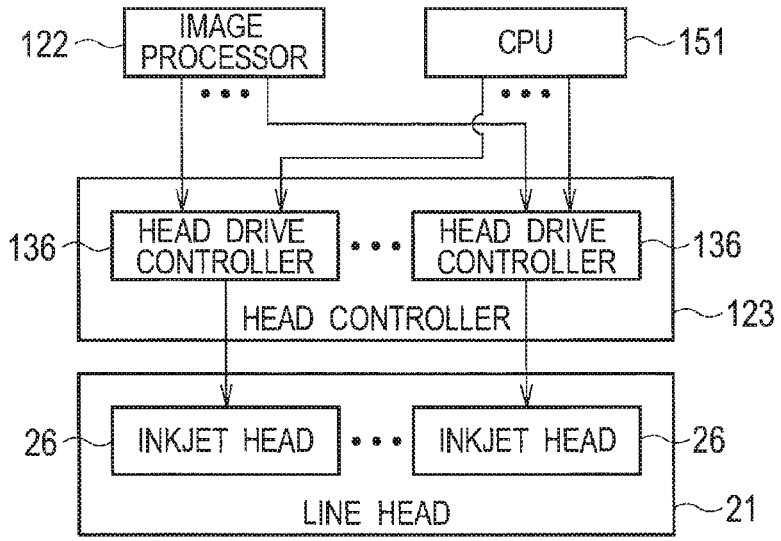
FIG. 9 is a block diagram illustrating the configuration of a head controller of the controller which is illustrated in FIG. 8.
Figure 10:
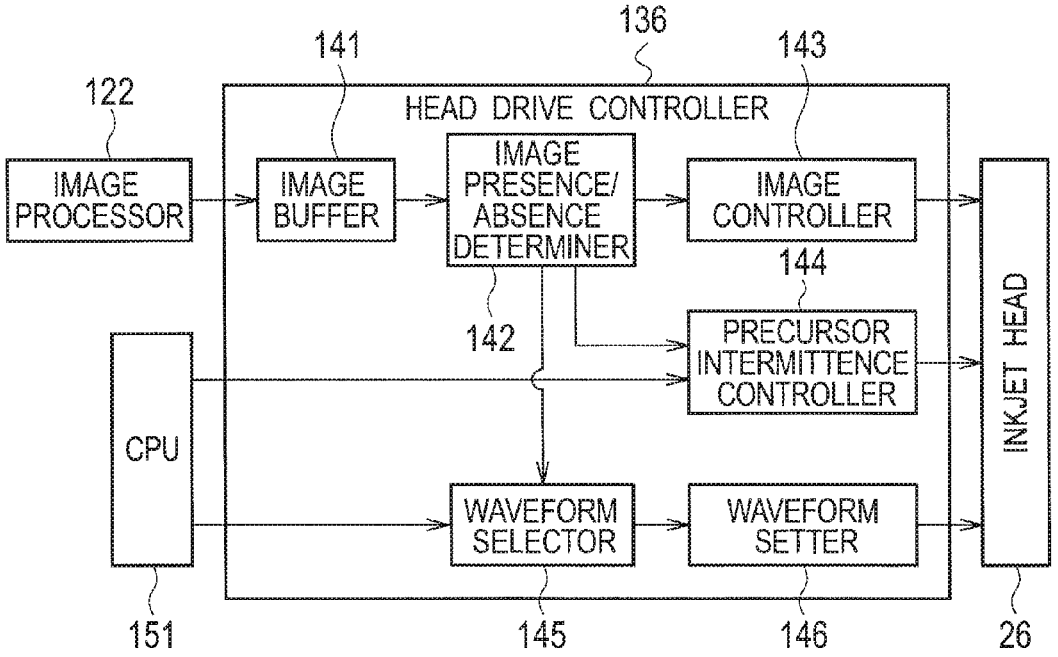
FIG. 10 is a block diagram illustrating the configuration of a head drive controller of the head controller which is illustrated in FIG. 9.

FIG. 1 is a block diagram illustrating the configuration of an inkjet printer 1 according to a first embodiment. FIG. 2 is a schematic configuration diagram of a conveyer 2, a head unit 3, and a head cooler 4 of the inkjet printer 1, which is illustrated in FIG. 1. FIG. 3 is a plan view of the conveyer 2, the head unit 3, and the head cooler 4. FIG. 4 is an exploded perspective view of the head unit 3 and the head cooler 4. FIG. 5 is a partially-enlarged cross-sectional view of the conveyer 2 and the head unit 3 taken along line V-V in FIG. 3. FIG. 6 is a partial cross-sectional view of an inkjet head. 26 taken along a horizontal plane. FIG. 7 is a schematic configuration diagram of an ink circulator 6 (6A, 6B), an ink feeder 7 (7A, 7B), and a pressure generator 8 of the inkjet printer 1, which is illustrated in FIG. 1. FIG. 8 is a block diagram illustrating the configuration of a controller 9 of the inkjet printer 1, which is illustrated in FIG. 1. FIG. 9 is a block diagram illustrating the configuration of a head controller 123 (123A, 123B) of the controller 9 which is illustrated in FIG. 8. FIG. 10 is a block diagram illustrating the configuration of a head drive controller 136 of the head controller 123 (123A, 123B) which is illustrated in FIG. 9.

In the following description, the direction perpendicular to the plane of the sheet of FIG. 2 is the front-rear direction, and the foreside of the plane of the sheet is the front side. Also, in FIGS. 2 to 7, 12, 13, 15, 17, 22, 24, 26, and 28, the directions of right, left, up, and down are denoted by RT, LT, UP, and DN, respectively. A direction from left to right in FIG. 2 is the direction of conveyance of a print medium P such as paper.

As illustrated in FIG. 1, the inkjet printer 1 according to the first embodiment includes the conveyer 2, the head unit 3, the head cooler 4, a head gap adjuster 5, the ink circulators 6A, 6B, the ink feeders 7A, 7B, the pressure generator 8, and the controller 9. Note that the alphabetical suffixes (A, B) in the reference numerals of the ink circulators 6A, 6B and the ink feeders 7A, 7B will sometimes be omitted to collectively describe them.

The conveyer 2 is configured to convey the print medium P. As illustrated in FIGS. 1 and 2, the conveyer 2 includes a conveying belt 11, a driving roller 12, driven rollers 13, 14, 15, a belt motor 16, and a print-medium attracting fan 17.

The conveying belt 11 is configured to convey the print medium P while attracting and holding it. The conveying belt 11 is a looped belt laid on the driving roller 12 and the driven rollers 13 to 15. A plurality of belt holes 11*a*, which are penetrating holes for air suction, are formed in the conveying belt 11. The conveying belt 11 attracts and holds the print medium P to and on its conveyance surface 11*b* with a sucking force generated at the belt holes ha by driving the print-medium attracting fan 17. The conveyance surface 11*b* is the upper surface of a horizontal section of the conveying belt 11 between the driving roller 12 and the driven roller 13. The conveying belt 11 conveys the print medium P attracted to and held on itself by rotating in the clockwise direction in FIG. 2.

The driving roller 12 is configured to rotate the conveying belt 11 in the clockwise direction in FIG. 2.

The driven rollers 13 to 15 support the conveying belt 11 along, with the driving roller 12. The driven rollers 13 to 15 are configured to be driven by the driving, roller 12 by means of the conveying belt 11. The driven roller 13 is arranged at the same level as the driving roller 12 and to the left of the driving roller 12. The driven rollers 14, 15 are arranged away from each other in the left-right direction at the same level but below the driving roller 12 and the driven roller 13.

The belt motor 16 is configured to rotationally drive the driving roller 12.

The print-medium attracting fan 17 is configured to generate a downward airflow. By (doing so, the print-medium attracting fan. 17 sucks air through the belt holes ha of the conveying belt 11 to generate negative pressure at the belt holes 11*a* and thereby attract the print medium P onto the conveying belt 11. The print-medium attracting fan 17 is arranged in an area surrounded by the looped conveying belt 11.

The head unit 3 is configured to eject inks onto the print medium P conveyed by the conveyer 2 to print an image thereon. The head unit 3 is arranged above the conveyer 2. The head unit 3 includes line heads 21A, 21B and a head holder 22. Note that the alphabetical suffixes (A, B) in the reference numerals of the ink line heads 21A, 21B will sometimes be omitted to collectively describe them.

The line heads 21A, 21B are configured to eject inks onto the print medium P. The line heads 21A, 21B eject inks of mutually different colors. The line heads 21A, 21B are arranged side by side along the direction of conveyance of the print medium P (left-right direction). Each line head 21A, 21B includes six inkjet heads 26.

As illustrated in FIGS. 3 and 4, the inkjet heads 26 are arranged in a staggered pattern. Specifically, in the line head 21, two head lines each formed of three inkjet heads 26 arranged at an equal interval along the front-rear direction are arranged to be offset from each other by a half of the pitch in the front-rear direction.

Each inkjet head 26 is configured to eject an ink through a plurality of nozzles (not illustrated) arranged along the main scanning direction (front-rear direction). The nozzles open to an ink election surface 26*a* of the inkjet head 26 which is its lower surface facing the conveyance surface 11*b* of the conveying belt 11. The inkjet head. 26 is capable of changing the number of droplets of the ink to be ejected through one nozzle for one pixel, and thus allows printing that expresses density by the number of droplets.

The inkjet head 26 is of a shear mode. As illustrated in FIG. 6, the inkjet head 26 includes a plurality of ink chambers 27 and a plurality of electrodes 28.

The ink chambers 27 are configured to hold the ink to be fed and eject the ink through the nozzles. The plurality of ink chambers 27 are arranged side by side along the main scanning direction (front-rear direction). The ink chambers 27 are separated from each other by partition walls 29 each of which is formed of a first piezoelectric member 30 and a second piezoelectric member 31. The first piezoelectric member 30 and the second piezoelectric member are made of a piezoelectric material such as PET ($PbZrO_3$—$PbTiO_3$) for example. The first piezoelectric member 30 and the second piezoelectric member 31 are polarized in mutually different directions as shown in arrows in FIG. 6.

The electrodes 28 are formed in intimate contact with the surfaces of the partition walls 29, which constitute the side surfaces of the ink chambers 27. The electrodes 28 are configured to change the volumes of the ink chambers 27 and the pressures inside the ink chambers 27 by causing shear deformation of the partition walls 29 in accordance with a driving signal. These changes eject the ink inside the ink chambers 27 through the nozzles.

The head holder 22 is configured to hold the line heads 21A, 21B. The head holder 22 is a box-shaped body formed in a hollow cuboidal shape. As illustrated in FIG. 4, the head holder 22 includes a bottom plate 41, side plates 42 to 45, and a top plate 46.

The bottom plate 41 is configured to hold and fix the inkjet heads 26 of the line heads 21A, 21B. The bottom plate 41 is formed in a rectangular shape. In the bottom plate 41, mount openings 41*a* for mounting the inkjet heads 26 are formed. As illustrated in FIG. 5, the inkjet heads 26 are inserted in and fixed to the mount openings 41*a* such that their ink ejection surfaces 26*a* project from the bottom plate 41 toward the conveyance surface 11*b* thereunder.

The side plates 42, 43, 44, 45 form the front, right, rear, and left sidewalls of the head holder 22, respectively. The side plates 42 to 45 are formed integrally with each other and stand on the periphery of the bottom plate 41.

Four vent holes 42*a* are formed in the front side plate 42. The vent holes 42*a* are air inlets through which air is blown into the head holder 22 by a later-described blower 51. The four vent holes 42*a* are formed in one-to-one correspondence on lines extending from the four head lines, which are formed by the inkjet heads 26 of the line heads 21A, 21B.

Four vent holes 44*a* are formed in the rear side plate 44. The vent holes 44*a* are air outlets through which air is sucked out of the head holder 22 by a later-described sucker 52. The four vent holes 44*a* are arranged at positions facing the four vent holes 42*a* of the front side plate 42, respectively. In other words, the four vent holes 44*a* are formed in one-to-one correspondence on lines extending from the four head Lines, which are formed by the inkjet heads 26 of the line heads 21A, 21B.

The top plate 46 is a lid closing the opening at the upper end of the sidewalls, which are formed of the side plates 42 to 45. The top plate 46 is formed in a rectangular shape.

The head cooler 4 is configured to cool the inkjet heads 26 by generating cooling air inside the head holder 22. The head cooler 4 includes the blower 51 and the sucker 52.

The blower 51 is configured to blow air into the head holder 22 from outside. The blower 51 is arranged at the front of the head holder 22. The blower 51 includes a blow chamber 56 and a blowing fan 57.

The blow chamber 56 forms an air flow path between the blowing fan 57 and the head holder 22. The blow chamber 56 is formed in a hollow shape elongated in the left-right direction. The blow chamber 56 is arranged on the front side plate 42 of the head holder 22. Four blow holes 56*a* are formed in a surface of the blow chamber 56 which is in contact with the side plate 42.

The blow holes 56*a* are air outlets through which air is blown into the head holder 22 from the blow chamber 56. The blow holes 56*a* are arranged at positions coinciding with the vent holes 42*a* of the side plate 42. In other words, the four blow hole 56*a* are formed in one-to-one correspondence on the lines extending from the four head lines, which are formed by the inkjet heads 26 of the line heads 21A, 21B.

The blowing fan 57 is configured to send air from one end of the blow chamber 56 into the blow chamber 56, so that air is blown into the head holder 22 through the blow holes 56*a* of the blow chamber 56.

The sucker 52 is configured to suck air out of the head holder 22. The sucker 52 is arranged at the rear of the head holder 22. The sucker 52 includes a suction Chamber 58 and a sucking fan 59.

The suction chamber 58 forms an air flow path between the head holder 22 and the sucking fan 59. The suction chamber 58 is formed in a hollow shape elongated in the left-right direction. The suction chamber 58 is arranged on the rear side plate 44 of the head holder 22. Four suction holes 58*a* are formed in a surface of the suction chamber 58 which is in contact with the side plate 44.

The suction holes 58*a* are air inlets through which air is sucked into the suction chamber 58 out of the head holder 22. The suction holes 58*a* are arranged at positions coinciding with the vent holes 44*a* of the side plate 44. In other words, the four suction holes 58*a* are formed in one-to-one correspondence on the lines extending from the four head lines, which are formed by the inkjet heads 26 of the line heads 21A, 21B.

The sucking fan 59 is configured to suck air from one end of the suction chamber 58, so that air is sucked out of the head holder 22 through the suction holes 58*a* of the suction chamber 58 and the vent holes 44*a* of the side plate 44.

The head gap adjuster 5 is configured to adjust a head gap Hg by raising and lowering the conveyer 2. The head gap Hg is the distance between the conveyance surface 11*b* of the conveying belt 11 and the ink ejection surfaces 26*a* of the inkjet heads 26.

The ink circulator 6 is configured to feed the ink to the line head 21 while circulating the ink. The ink circulators 6A, 6B are configured to feed the inks to the line heads 21A, 21B, respectively. As illustrated in FIG. 7, the ink circulator 6 includes a positive pressure tank 61, an ink distributor 62, an ink collector 63, a negative pressure tank 64, an ink pump 65, an ink temperature adjuster 66, a circulated-ink temperature sensor 67, six head-ink temperature sensors 68, and ink circulation pipes 69 to 71.

The positive pressure tank 61 is configured to store the ink to be fed to the line 21. The ink in the positive pressure tank 61 is fed to the line head 21 through the ink circulation pipe 69 and the ink distributor 62. Inside the positive pressure tank 61, an air layer 76 is formed on the surface of the ink. The positive pressure tank 61 is connected to a later-described positive-pressure common air chamber 91 by a later-described positive-pressure-side communication pipe 92. The positive pressure tank 61 is arranged at a position lower than the line head 21.

The positive pressure tank 61 is provided with a positive-pressure-tank liquid level sensor 77 and an ink filter 78.

The positive-pressure-tank liquid level sensor 77 is configured to detect whether or not the liquid level of the ink inside the positive pressure tank 61 has reached a reference level (reference height). The positive-pressure-tank liquid level sensor 77 outputs a signal indicating ON when the liquid level inside the positive pressure tank 61 is at or above the reference level, and outputs a signal indicating "OFF" when the liquid level is below the reference level.

The ink filter 78 is configured to remove foreign particles and the like in the ink.

The ink distributor 62 is configured to distribute the ink which is fed from the positive pressure tank 61 through the ink circulation pipe 69, to the inkjet heads 26 of the line head 21.

The ink collector 63 is configured to collect the ink which is not consumed at the line head 21 from the in heads 26. The ink collected by the ink collector 63 flows into the negative pressure tank 64 through the ink circulation pipe 70.

The negative pressure tank 64 is configured to receive the ink which is not consumed at the line head 21 from the ink collector 63 and store it. Moreover, the negative pressure tank 64 is configured to store ink fed from an ink cartridge 86 of the later-described ink feeder 7. Inside the negative pressure tank 64, an air layer 79 is formed on the surface of the ink. The negative pressure tank 64 is in communication with a later-described negative-pressure common air chamber 98 through later-described negative-pressure-side communication pipe 99. The negative pressure tank 64 is arranged at the same level as the positive pressure tank 61.

The negative pressure tank 64 is provided with a negative-pressure-tank liquid level sensor 80. The negative-pressure-tank liquid level sensor 80 is configured to detect whether or not the liquid level of the ink inside the negative pressure tank 64 has reached a reference level (reference height). The negative-pressure-tank liquid level sensor 80 outputs a signal indicating "ON" when the liquid level inside the negative pressure tank 64 is at or above the reference level, and outputs a signal indicating "OFF" when the liquid level is below the reference level.

The ink pump 65 is configured to send the ink from the negative pressure tank 64 into the positive pressure tank 61. The ink pump 65 is provided at a midway point on the ink circulation pipe 71.

The ink temperature adjuster 66 is configured to adjust the temperature of the ink at the ink circulator 6. The ink temperature adjuster 66 is provided at a midway point on the ink circulation pipe 69. The ink temperature adjuster 66 includes a heater 81, a heater temperature sensor 82, a heat sink 83, and an ink cooling fan 84.

The heater 81 is configured to heat the ink which flows through the ink circulation pipe 69. The heater temperature sensor 82 is configured to detect the temperature of the heater 81. The heat sink 83 is configured to receive heat from the ink flowing through the ink circulation pipe 69 and dissipate the heat. The ink cooling fan 84 is configured to cool the ink flowing through the ink circulation pipe 69 by sending air to the heat sink 83.

The circulated-ink temperature sensor 67 is configured to detect the temperature of the ink at the ink circulator 6. The circulated-ink temperature sensor 67 is provided at a midway point on the ink circulation pipe 69.

The head-ink temperature sensors 68 are configured to detect the temperatures of the ink at the inkjet heads 26. The head-ink temperature sensors 68 are arranged on paths leading from the inkjet heads 26 to the ink collector 63.

The ink circulation pipe 69 connects the positive pressure tank 61 and the ink distributor 62. A part of the ink circulation pipe 69 is branched into a section which passes the heater 81 and a section which passes the heat sink 83. In the ink circulation pipe 69, the ink flows from the positive pressure tank 61 toward the ink distributor 62. The ink circulation pipe 70 connects the ink collector 63 and the negative pressure tank 64. In the ink circulation pipe 70, the ink flows from the ink collector 63 toward the negative pressure tank 64. The ink circulation pipe 71 connects the negative pressure tank 64 and the positive pressure tank 61. In the ink circulation pipe 71, the ink flows from the negative pressure tank 64 toward the positive pressure tank 61.

The ink feeders 7A, 7B are configured to feed the inks to the ink circulators 6A, 6B respectively. The ink feeder 7 includes the ink cartridge 86, an ink feed valve 87, and an ink feed pipe 88.

The ink cartridge 86 houses the ink to be used by the line head 21 for printing. The ink inside the ink cartridge 86 is fed into the negative pressure tank of the ink circulator 6 through the ink feed pipe 88.

The ink feed valve 87 is configured to open and close the ink flow path inside the ink feed pipe 88. The ink feed valve 87 is opened at the time of feeding the ink into the negative pressure tank.

The ink feed pipe 88 connects the ink cartridge 86 and the negative pressure tank 64. In the ink feed pipe 88, the ink flows from the ink cartridge 86 toward the negative pressure tank 64.

The pressure generator 8 is configured to generate pressures in the positive pressure tank 61 and the negative pressure tank 64 of the ink circulator 6 for ink circulation. The ink circulators 6A, 6B share the pressure generator 8. The pressure generator 8 includes a positive-pressure common air chamber 91, two positive-pressure-side communication pipes 92, a positive-pressure-side atmosphere release valve 93, a positive-pressure-side atmosphere release pipe 94, a positive-pressure-side pressure adjustment valve 95, a positive-pressure-side pressure adjustment pipe 96, a positive-pressure-side pressure sensor 97, a negative-pressure common air chamber 98, two negative-pressure-side communication pipes 99, a negative-pressure-side atmosphere release valve 100, a negative-pressure-side atmosphere release pipe 101, a negative-pressure-side pressure adjustment valve 102, a negative-pressure-side pressure adjustment pipe 103, a negative-pressure-side pressure sensor 104, an air pump 105, an air pump 106, a junction pipe 107, an air filter 108, and an overflow pan 109.

The positive-pressure common air chamber 91 is an air chamber configured to make the pressure in the positive pressure tank 61 of the ink circulator 6A and the pressure in the positive pressure tank 61 of the ink circulator 6B equal to each other. The positive-pressure common air chamber 91 is communication with the air layers 76 in the positive pressure tanks 61 of the two ink circulators 6A, 6B through the two positive-pressure-side communication pipes 92. Thus, the positive pressure tanks 61 of the ink circulators 6A, 6B are in communication with each other through the positive-pressure common air chamber 91 and the positive-pressure-side communication pipes 92.

The positive-pressure-side communication pipes 92 allow communication between the positive-pressure common air chamber 91 and the air layers 76 in the positive pressure tanks 61. The two positive-pressure-side communication pipes 92 are provided in one-to-one correspondence to the two ink circulators 6A, 6B. Each positive-pressure-side communication pipe 92 is connected at one end to the positive-pressure common air chamber 91 and connected at the other end to the air layer 76 in the positive pressure tank 61.

The positive-pressure-side atmosphere release valve 93 is configured to open and close the air flow path in the positive-pressure-side atmosphere release pipe 94 to switch the state of each positive pressure tank 61 between a tightly closed state (a state of being shut off from the atmosphere) and an atmospherically open state (a state of being communicating with the atmosphere) through the positive-pressure common air chamber 91 and the positive-pressure-side communication pipe 92. The positive-pressure-side atmosphere release valve 93 is provided at a midway point on the positive-pressure-side atmosphere release pipe 94.

The positive-pressure-side atmosphere release pipe 94 forms an air flow path for opening each positive pressure tank 61 to the atmosphere through the positive-pressure common air chamber 91 and the positive-pressure-side communication pipe 92. The positive-pressure-side atmosphere release pipe 94 is connected at one end to the positive-pressure common air chamber 91 and connected at the other end to the junction pipe 107.

The positive-pressure-side pressure adjustment valve 95 is configured to open and close the air flow path in the positive-pressure-side pressure adjustment pipe 96 to adjust the pressures in the positive-pressure common air chamber 91 and each positive pressure tank 61. The positive-pressure-side pressure adjustment valve 95 is provided at a midway point on the positive-pressure-side pressure adjustment pipe 96.

The positive-pressure-side pressure adjustment pipe 96 forms an air flow path for adjusting the pressures in the positive-pressure common air chamber 91 and each positive pressure tank 61. The positive-pressure-side pressure adjustment pipe 96 is connected at one end to the positive-pressure common air chamber 91 and connected at the other end to the junction pipe 107.

The positive-pressure-side pressure sensor 97 is configured to detect the pressure in the positive-pressure common air chamber 91. The pressure in the positive-pressure common air chamber 91 is equal to the pressure in the positive pressure tank 61 of each ink circulator 6A, 6B because the positive-pressure common air chamber 91 and the air layer 76 in the positive pressure tank 61 of the ink circulator 6A, 6B are in communication with each other.

The negative-pressure common air chamber 98 is an air chamber configured to make the pressure in the negative pressure tank 64 of the ink circulator 6A and the pressure in the negative pressure tank 64 of the ink circulator 6B equal to each other. The negative-pressure common air chamber 98 is in communication with the air layers 79 in the negative pressure tanks 64 of the two ink circulators 6A, 6B through the two negative-pressure-side communication pipes 99. Thus, the negative pressure tanks 64 of the in circulators 6A, 6B are in communication with each other through the negative-pressure common air chamber 98 and the negative-pressure-side communication pipes 99.

The negative-pressure-side communication pipes 99 allow communication between the negative-pressure common air chamber 98 and the air layers 79 in the negative pressure tanks 64. The two negative-pressure-side communication pipes 99 are provided in one-to-one correspondence to the two ink circulators 6A, 6B. Each negative-pressure-side communication pipe 99 is connected at one end to the negative-pressure common air chamber 98 and connected at the other end to the air layer 79 in the negative pressure tank 64.

The negative-pressure-side atmosphere release valve 100 is configured to open and close the air flow path in the negative-pressure-side atmosphere release pipe 101 to switch the state of each negative pressure tank 64 between a tightly closed state and an atmospherically open state through the negative-pressure common air chamber 98 and the negative-pressure-side communication pipe 99. The negative-pressure-side atmosphere release valve 100 is provided at a midway point on the negative-pressure-side atmosphere release pipe 101.

The negative-pressure-side atmosphere release pipe 101 forms an air flow path for opening each negative pressure tank 64 to the atmosphere through the negative-pressure common air chamber 98 and the negative-pressure-side communication pipe 99. The negative-pressure-side atmosphere release pipe 101 is connected at one end to the negative-pressure common air chamber 98 and connected at the other end to the junction pipe 107.

The negative-pressure-side pressure adjustment valve 102 is configured to open and close the air flow path in the negative-pressure-side pressure adjustment pipe 103 to adjust the pressures in the negative-pressure common air chamber 98 and each negative pressure tank 64. The negative-pressure-side pressure adjustment valve 102 is provided at a midway point on the negative-pressure-side pressure adjustment pipe 103.

The negative-pressure-side pressure adjustment pipe 103 forms an air flow path for adjusting the pressures in the negative-pressure common air chamber 98 and each negative pressure tank 64. The negative-pressure-side pressure (adjustment pipe 103 is connected at one end to the negative-pressure common air chamber 98 and connected at the other end to the junction pipe 107.

The negative-pressure-side pressure sensor 104 is configured to detect the pressure in the negative-pressure common air chamber 98. The pressure in the negative-pressure common air chamber 98 is equal to the pressure in the negative pressure tank 64 of each ink circulator 6A, 6B because the negative-pressure common air chamber 98 and the air layer 79 in the negative pressure tank 64 of the ink circulator 6A, 6B are in communication with each other.

The air pump 105 is configured to suck air out of the negative pressure tanks 64 of the ink circulators 6A, 6B through the negative-pressure common air chamber 98 and send air into the positive pressure tanks 61 of the ink circulators 6A, 6B through the positive-pressure common air chamber 91. The air pump 105 is provided at a midway point on the air pump pipe 106.

The air pump pipe 106 forms a flow path for the air to be sent from the negative-pressure common air chamber 98 to the positive-pressure common air chamber 91 by the air pump 105. The air pump pipe 106 is connected at one end to the positive-pressure common air chamber 91 and connected at the other end to the negative-pressure common air chamber 98.

The junction pipe 107 is connected at one end to the overflow pan 109 and is in communication at the other end (upper end) with the atmosphere through the air filter 108. The end of the junction pipe 107 on the overflow pan 109 side is normally closed by a later-described overflow ball 110. The positive-pressure-side atmosphere release pipe 94, the positive-pressure-side pressure adjustment pipe 96, the negative-pressure-side atmosphere release pipe 101, and the negative-pressure-side pressure adjustment pipe 103 are connected to the junction pipe 107. Thus, the positive-pressure-side atmosphere release pipe 94, the positive-pressure-side pressure adjustment pipe 96, the negative-pressure-side atmosphere release pipe 101, and the negative-pressure-side pressure adjustment pipe 103 are in communication with the atmosphere.

The air filter 108 is configured to prevent entry of foreign particles and the like in the ambient air into the junction pipe 107. The air filter 108 is placed at the upper end of the junction pipe 107.

The overflow pan 109 is configured such that in the case, for example, of malfunction of the ink feed valve 87, which causes the ink to overflow from the positive pressure tank 61 and the negative pressure tank 64 and further from the positive-pressure common air chamber 91 and the negative-pressure common air chamber 98, the overflow pan 109 receives the ink flowing out from the junction pipe 107.

The overflow pan 109 is provided with the overflow ball 110. The overflow ball 110 is configured to close the end of the junction pipe 107 that is open to the bottom surface of the overflow pan 109 to prevent the ambient air from flowing into the junction pipe 107 while no ink is in the overflow pan 109. When the ink flows through the junction pipe 107 to the overflow pan 109, the overflow ball 110 is lifted up, thereby allowing the ink to flow into the overflow pan 109.

The overflow pan 109 is further provided with an overflow liquid level sensor 111. The overflow liquid level sensor 111 is configured to detect whether or not the liquid level of the ink inside the overflow pan 109 has reached a predetermined level.

The overflow pan 109 is connected to an effluent tank (not illustrated) and is configured to discharge the ink into the effluent tank when the overflow liquid level sensor 111 detects the surface of the ink.

The controller 9 is configured to control the operation of the entire inkjet printer 1. As illustrated in FIG. 8, the controller 9 includes a controller unit 121, an image processor 122, the head controllers 123A, 123B, and an actuator controller 124. Note that the alphabetical suffixes (A, B) in the reference numerals of the head controllers 123A, 123B will sometimes be omitted to collectively describe them.

The controller unit 121 is configured to receive a print job from an external personal computer and decompress compressed image data contained in the print job. As a result, image data of each color is obtained. The image data of each color is data indicating the number of droplets of the ink of the color for each pixel.

The controller unit 121 includes a central processing unit (CPU) 131, a read only memory (ROM) 132, a random access memory (RAM) 133, a hard disk drive (HOD) 134, and an external interface (I/F) 135.

The CPU 131 is configured to execute arithmetic processing. The ROM 132 is configured to store basic programs and the like. The RAM 133 is used as a work area for the CPU 131 for temporarily data and performing arithmetic operation. The HDD 134 is configured to store various programs and the like. The external I/F 135 is configured to exchange data with external devices through a network.

The image processor 122 is configured to divide the image data of each color into a piece of image data per inkjet head 26 and output these pieces of image data to the head controllers 123A, 123B. Also, the image processor 122 configured to output job data to the actuator controller 124. The job data contains information indicating the size of the print medium, the type of the print medium, the number of medium to be printed, and the like.

The head controllers 123A, 123B are configured to control the drive of the line heads 21A, 21B, respectively. As illustrated in FIG. 9, the head controller 123 includes six head drive controllers 136 corresponding to the inkjet heads 26.

Each head drive controller 136 is configured to output the image data to its inkjet head 26 and causes the inkjet head 26 to perform ink election per line of the image. The head drive controller 136 is also configured to control the inkjet head 26 to perform precursor drive (non-ejection drive) on at least some of lines which involve no ink ejection. The head drive controller 136 determines a precursor ratio Rp (non-ejection drive ratio) in accordance with the position of the inkjet head 26. The precursor drive is the driving of the head 26 to such a degree as to eject no ink. In the precursor drive, the inkjet head 26 ejects no ink but generates heat. The precursor ratio Rp is the ratio of the lines on which to perform the precursor drive to the lines which involve no ink ejection (contain no image).

As illustrated in FIG. 10, each head drive controller 136 includes an image buffer 141, an image presence/absence determiner 142, an image controller 143, a precursor intermittence controller 144, a waveform selector 145, and a waveform setter 146.

The image buffer 141 is configured to store a predetermined number of lines of image data. The image buffer 141 stores the predetermined number of lines of image data while shifting the target line by line.

The image presence/absence determiner 142 is configured to determine the presence or absence of an image on each line of the image data. The image presence/absence determiner 142 is configured to output image presence/absence information indicating the presence or absence of an image on each line to the precursor intermittence controller 144 and the waveform selector 145.

The image controller 143 is configured to output the image data to the inkjet head 26 per group of ink chambers 27 to be described later.

The precursor intermittence controller 144 is configured to control the precursor drive of the in head 26 on lines containing no image.

The waveform selector 145 is configured to select an ejection waveform or a precursor waveform as a drive waveform with which to drive the inkjet head 26, based on the image presence/absence information. The ejection waveform is a drive waveform for causing the inkjet head 26 to perform ink ejection. The precursor waveform is a drive waveform for causing the inkjet head 26 to perform the precursor drive. The inkjet head 26 is capable of changing its drive waveform line by line.

The waveform setter 146 is configured to set the drive waveform selected by the waveform selector 145 as the drive waveform of the inkjet head 26.

The actuator controller 124 is configured to perform control processes such as controlling the conveyance of the print medium by the conveyer 2, controlling the ink circulation by the ink circulators 6A, 6B, controlling the ink feed by the ink feeders 7A, 7B, and controlling the pressures generated by the pressure generator 8. The actuator controller 124 includes a CPU 151, a ROM 152, a RAM 153, a driver unit 154, and a sensor I/F 155.

The CPU 151 is configured to execute arithmetic processing. The ROM 152 is configured to store a later-described positional coefficient Kp and the like. The RAM 153 is used as a work area for the CPU 151 for temporarily storing data and performing arithmetic operation. The driver unit 154 includes various drivers for driving various motors, fans, and pumps such as the belt motor 16, the print-medium attracting fan 17, and the ink pump 65. The sensor I/F 155 is configured to receive signals from various sensors such as the positive-pressure-tank liquid level sensor 77.

Next, the operation of each inkjet head 26 will be described.

Figure 11:
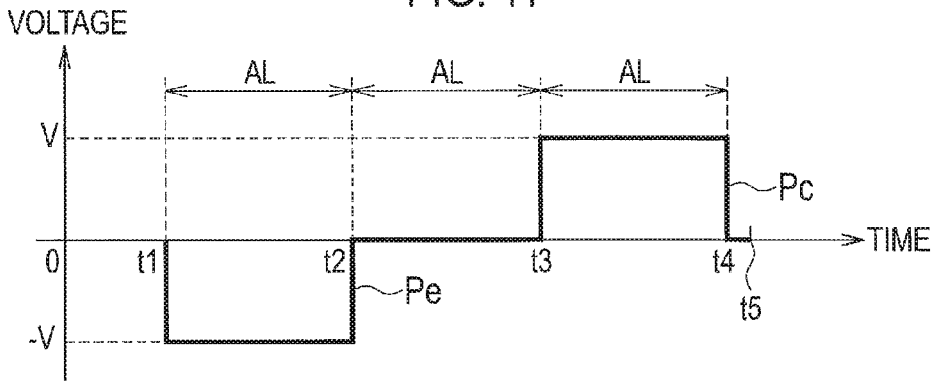
FIG. 11 is a waveform chart of an ejection waveform.
Figure 12:
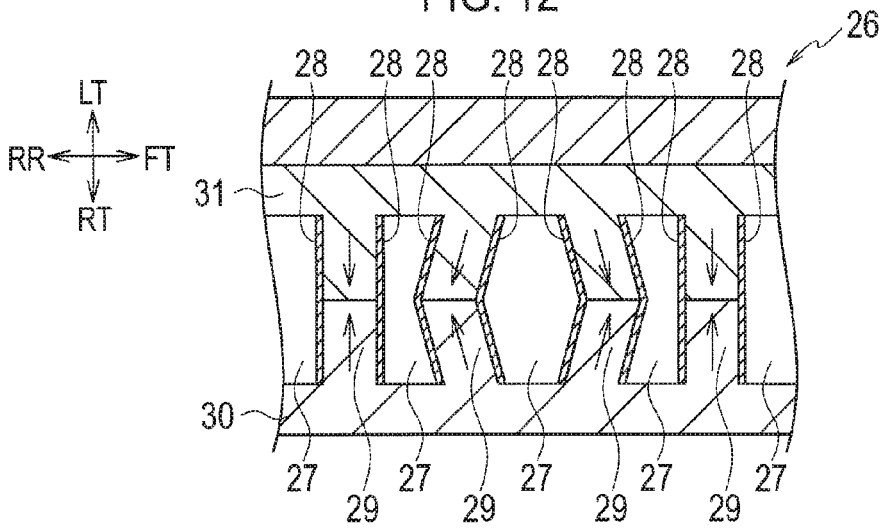
FIG. 12 is an operation diagram for describing ejecting operation at an inkjet head.
Figure 13:
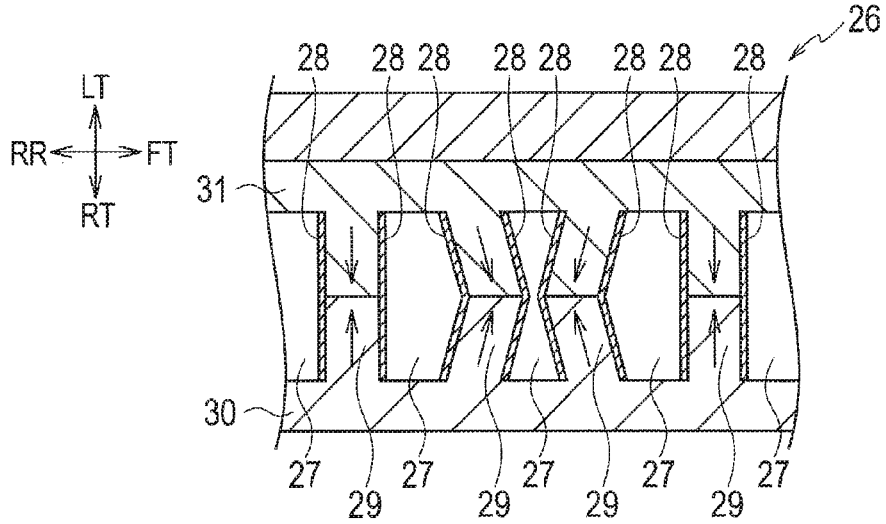
FIG. 13 is an operation diagram for describing the ejecting operation at the inkjet head.

FIG. 11 is a waveform chart of the election waveform. FIGS. 12 and 13 are operation diagrams for describing the ejecting operation of the inkjet head 26.

The description will be given focusing on the ink ejection from the center ink chamber 27 in FIG. 6. At a time t1 in FIG. 11, the electrodes 28 in the adjacent ink chambers 27 on both sides of the center ink chamber 27 which is the ejection target are grounded and a negative-voltage (−V) expansion pulse Pe is applied to the electrodes 28 in the center ink chamber 27 from the normal state illustrated in FIG. 6.

The application of the expansion pulse Pe to the electrodes 28 generates an electric field in a direction perpendicular to the direction of polarization of the first piezoelectric member 30 and the second piezoelectric member 31 which constitute the partition walls 29 on both sides of the center ink chamber 27. This results in shear deformation at the surfaces of the first piezoelectric member 30 and the second piezoelectric member 31 joined to each other, so that, as illustrated in FIG. 12, the partition walls 29 on both sides of the center ink chamber 27 are deformed away from each other and thereby expand the volume of the ink chamber 27. As a result, the ink flows into the center ink chamber 27.

The pulse length (application time) of the expansion pulse Pe is 1 AL. This AL is an acoustic length denoting a time required to propagate a pressure wave over the entire ink chamber 27, more specifically, a time from when the pressure wave is generated upon flowing of the ink into the ink chamber 27 whose volume is expanded, to when the pressure wave reaches the corresponding nozzle. The AL is determined depending on the structure of the inkjet head 26, the ink concentration, and other relevant factors.

At a time t2 in FIG. 11, the voltage applied to the electrodes 28 in center ink chamber 27 is set back to the ground voltage from the state in FIG. 12, so that the partition walls 29 on both sides of the center ink chamber 27 return to the neutral position in FIG. 6 from the state in FIG. 12. As a result, the ink in the center ink chamber 27 is abruptly pressurized and the ink is therefore ejected through the corresponding nozzle.

After the elapse of an intermission time of 1 AL since the voltage applied to the electrodes 28 in the center ink chamber 27 is set back to the ground potential, a positive-voltage (V) contraction pulse Pc is applied to the electrodes 28 in the center ink chamber 27 for a period of 1 AL from a time t3 to a time t4. As illustrated in FIG. 13, the application of this contraction pulse Pc deforms the partition walls 29 on both sides of the center ink chamber 27 toward each other and thereby constrict the volume of the cent r ink chamber 27.

The ink is ejected as the pressure in the ink chamber 27 peaks immediately after the end of application of the expansion pulse Pe. After the pressure peaks, a negative pressure generated in the ink chamber 27. By applying the contraction pulse Pc, the volume of the ink chamber 27 is constricted, which generates a pressurizing force. The pressurizing force suppresses the negative pressure in the ink chamber 27 after the ink ejection and thereby damps residual vibration of the ink in the ink chamber 27. In this way, the next ejecting operation can be performed stably.

After the application of the contraction pulse Pc, the voltage applied to the electrodes 28 in the center ink chamber 27 is set to the ground potential from the time t4 to a time t5 and thus the center ink chamber 27 returns to the state in FIG. 6. By this step, one ejecting operation (one droplet ejection) ends.

Since the shear-mode inkjet head 26 performs ink ejection by deforming the partition walls 29 in the above-described manner, the ink chambers 27 adjacent to each other cannot be simultaneously driven for ink ejection. For this reason, all the ink chambers 27 included in the inkjet head 26 are divided into a plurality of groups each formed of ink chambers 27 that are not adjacent to each other, and the ink chambers 27 are driven on a group-by-group basis for ink ejection. For example, the ink chambers 27 of the inkjet head 26 are divided into three groups such that every third ink chamber 27 belongs to the same group.

The drive of the ink chambers 27 is controlled such that drive periods are sequentially assigned to these groups, with one cycle being equal to a total period in which a drive period is assigned to all the groups once. In this way, one line in the main scanning direction is printed per cycle.

Each ink chamber 27 is driven for ink ejection a given number of times that corresponds to the number or droplets for each pixel based on the image data within the drive period given to the group to which the ink chamber 27 belongs. The maximum number of droplets (e.g. five droplets) to be ejected within one drive period is set in advance, and the number of droplets to be ejected within each drive period is smaller than or equal to the maximum number of droplets. In some drive period, the ink chamber 27 may not be driven for ink ejection (the number of droplets may be zero). Also, in this embodiment, the ink chamber 27 may be subjected to the precursor drive.

Next, the operation of the inkjet head 26 during the precursor drive will be described.

Figure 14:
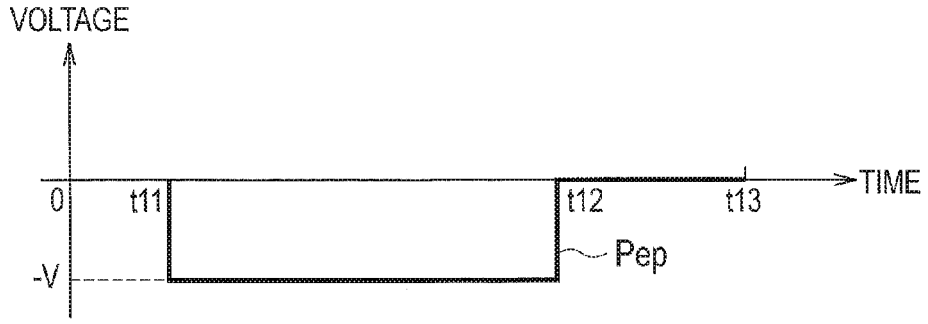
FIG. 14 is a waveform chart of a precursor waveform.

The description will be given focusing on the precursor drive of the center ink chamber 27 in FIG. 6. FIG. 14 is a waveform chart of the precursor waveform. At a time t11 in FIG. 14, the electrodes 28 in the adjacent ink chambers 27 on both sides of the center ink chamber 27 are grounded and a negative-voltage (−V) expansion pulse Pep is applied to the electrodes 28 in the center ink chamber 27 from the normal state illustrated in FIG. 6.

As in FIG. 12, the application of the expansion pulse Pep to the electrodes 28 deforms the partition walls 29 on both sides of the center ink chamber 27 away from each other and thereby expand the volume of the ink chamber 27. As a result, the ink flows into the center ink chamber 27.

The pressure in the center ink chamber 27 increases when the ink flows in, but the pressure decreases with time. The pulse length (application time) of the expansion pulse Pep in the precursor waveform is set to be a time longer than 1 AL in order for the pressure in the ink chamber 27 to decrease to such a degree as to eject no ink when the ink chamber 27 returns to the normal state after the end of application of the expansion pulse Pep.

When the application of the expansion pulse Pep ends at a time t12 in FIG. 14, the partition walls 29 on both sides of the center ink chamber 27 return to the neutral position in FIG. 6. Since the pulse length of the expansion pulse Pep is set as described above, the ink is not ejected when the partition walls 29 return to the neutral position.

After the application of the expansion pulse Pep, the electrodes 28 in the center ink chamber 27 are set to the ground potential from the time t12 to a time t13. By this step, one precursor drive ends. The length of time of one precursor drive (times t11 to t13) is equal to the length of time of ejection of one droplet in the ejection waveform in FIG. 11 (times t1 to t5).

Next, the printing operation of the inkjet printer 1 will be described.

Upon input of a print job, the CPU 131 of the controller unit 121 divides the print job into job data and compressed image data and decompresses the compressed image data. As a result, image data of the given colors corresponding to the line heads 21A, 21B is obtained. The CPU 131 outputs the job data and the image data to the image processor 122.

The image processor 122 divides the image data of each color into a piece of image data per inkjet head 26 and outputs these pieces of image data to the head drive controllers 136 of the head controllers 123A, 123B. Also, the image processor 122 outputs the job data to the actuator controller 124.

The CPU 151 of the actuator controller 124 acquires information indicating the type of the print medium from the job data. Then, the CPU 151 controls the head gap (adjuster 5 such that the head gap Hg matches the type of the print medium.

Also, the CPU 151 starts ink circulating operation. Specifically, the CPU 151 firstly closes the positive-pressure-side atmosphere release valve 93 and the negative-pressure-side atmosphere release valve 100. As a result, the positive pressure tanks 61 of the ink circulators 6A, 6B shift to the tightly closed state through the positive-pressure common air chamber 91 and other relevant components, and the negative pressure tanks 64 of the ink circulators 6A, 6B shift to the tightly closed state through the negative-pressure common air chamber 98 and other relevant components. Note that during a standby state in which the inkjet printer 1 is not in operation, the positive-pressure-side atmosphere release valve 93 and the negative-pressure-side atmosphere release valve 100 are opened and the positive-pressure-side pressure adjustment valve and the negative-pressure-side pressure adjustment valve 102 are closed.

Thereafter, the CPU 151 activates the air pump 105, so that air is sent from the negative-pressure common air chamber 98 into the positive-pressure common air chamber 91, thereby depressurizing the negative-pressure common air chamber 98 and each negative pressure tank 64 and pressurizing the positive-pressure common air chamber 91 and each positive pressure tank 61. As a result, the ink flows from the positive pressure tank 61 toward the line head 21.

The CPU 151 stops the air pump 105 when the pressure in the positive-pressure common air chamber 91 and the positive pressure tank 61 (pressure on the positive pressure side), which is detected by the positive-pressure-side pressure sensor 97, and the pressure in the negative-pressure common air chamber 98 and the negative pressure tank 64 (pressure on the negative pressure side), which is detected by the negative-pressure-side pressure sensor 104, reach preset pressures Pk, Pf, respectively. Here, after the activation of the air pump 105, the CPU 151 controls the opening and closing of the positive-pressure-side pressure adjustment valve 95 and the negative-pressure-side pressure adjustment valve 102 in accordance with the detection values of the positive-pressure-side pressure sensor 97 and the negative-pressure-side pressure sensor 104 such that the pressure on the positive pressure side and the pressure on the negative pressure side can be the preset pressures Pk, Pf.

Each preset pressure Pk, Pf is set in advance as a pressure value for circulating the in at a predetermined ink circulation flow rate in the ink circulator 6A, 6B and setting the nozzle pressure of each inkjet head 26 at an appropriate value (negative pressure).

When the pressure on the positive pressure side and the pressure on the negative pressure side reach the preset pressures Pk, Pf, the CPU 151 activates the driving roller 12 by means of the belt motor 16. As a result, the conveying belt 11 starts to be rotationally driven.

Figure 15:
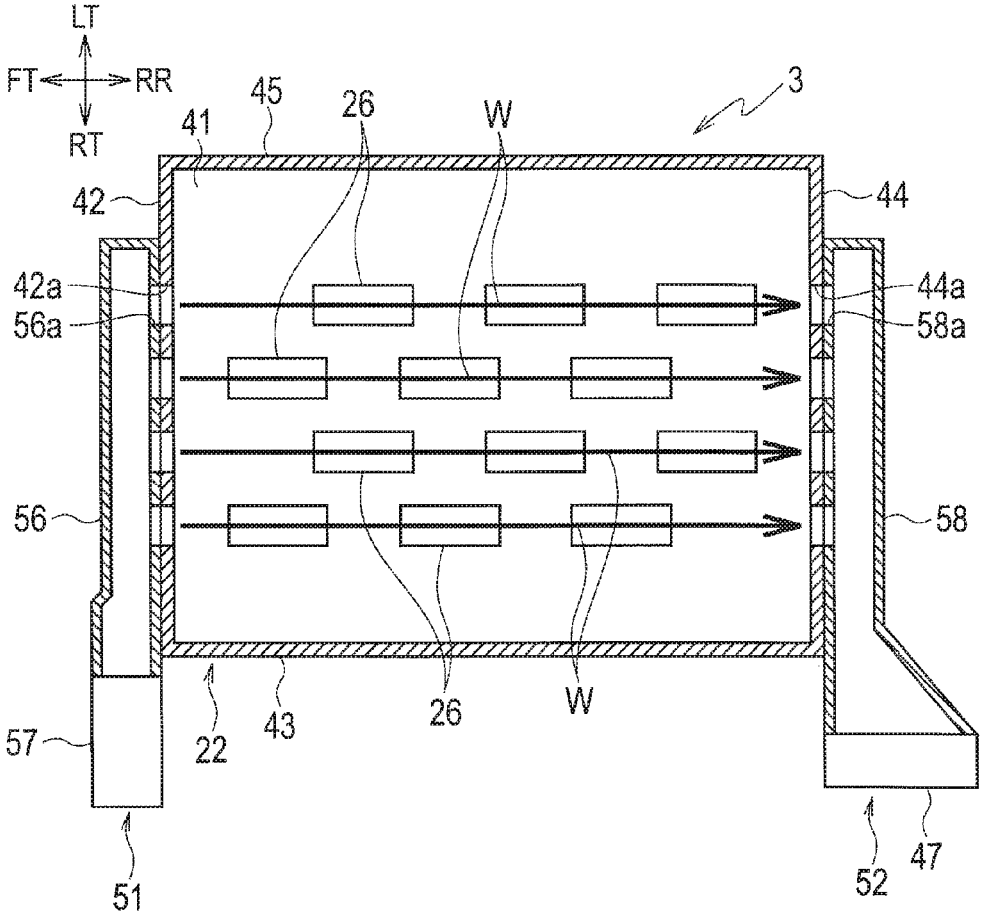
FIG. 15 is a diagram illustrating cooling air generated inside a head holder.

Also, the CPU 151 activates the blowing fan 57 and the sucking fan 59. With the blowing fan 57 driven, air is blown into the head holder 22 through the blow holes 56*a* of the blow chamber 56 and the vent holes 42*a* of the side plate 42 of the head holder 22. Also, with the sucking fan 59 driven, air is sucked out of the head holder 22 through the vent holes 44*a* of the side plate 44 of the head holder 22 and the suction holes 58*a* of the suction chamber 58. As a result, cooling air W is generated inside the head holder 22 which flows from the front to the rear as illustrated in FIG. 15.

Also, the CPU 151 activates the print-medium attracting fan 17. As a result, the print-medium attracting fan 17 sucks air through the belt holes ha of the conveying belt 11, thereby generating an attracting force at the belt holes 11*a*. When a print medium P is fed onto the conveyer 2 from a paper feeder not illustrated, the print medium P is conveyed by the conveying belt 11 while being attracted to and held on the conveying belt 11.

Upon input of the image data into each head drive controller 136 from the image processor 122, the predetermined number of lines of image data are stored in the image buffer 141. The image presence/absence determiner 142 reads the image data from the image buffer 141 line by line and determines the presence or absence of an image on each line. Once the image presence/absence determiner 142 reads a line of image data, the next line of image data is stored into the image buffer 141.

The image presence/absence determiner 142 determines that a line contains no image if the number of droplets at all of its pixels is "0." The image presence/absence determiner 142 determines that a line contains an image if the number of droplets at any of its pixels is not "0." The image presence/absence determiner 142 outputs image presence/absence information indicating the presence or absence of an image on each line to the precursor intermittence controller 144 and the waveform selector 145. Also, the image presence/absence determiner 142 outputs the lines of image data for which the image presence/absence determiner 142 has finished determining the presence or absence of an image, to the image controller 143.

Based on the image data thus inputted, the image controller 143 causes the inkjet head 26 to eject the ink to print an image onto the print medium P conveyed by the conveyer 2.

The image presence/absence information is used for precursor drive control during the printing operation. The precursor drive control will be described later.

During the printing operation, the CPU 151 performs liquid-level maintaining control. The liquid-level maintaining control is the controlling of the ink pump 65 and the in feed valve 87 to perform ink circulation while maintaining the liquid levels inside the positive pressure tank 61 and the negative pressure tank 64 at the reference levels.

Specifically, the CPU 151 turns off the ink pump 65 and closes the ink feed valve 87 in a state where the positive-pressure-tank liquid level sensor 77 and the negative-pressure-tank liquid level sensor 80 are both on. The CPU 151 likewise turns off the ink pump 65 and closes the ink feed valve 87 in a state where the positive-pressure-tank liquid level sensor 77 is on and the negative-pressure-tank liquid level sensor 80 is off. The CPU 151 turns on the ink pump 65 and closes the ink feed valve 87 in a state where the positive-pressure-tank liquid level sensor 77 is off and the negative-pressure-tank liquid level sensor 80 is on. The CPU 151 turns off the ink pump 65 and opens the ink feed valve 87 in a state where the positive-pressure-tank liquid level sensor 77 and the negative-pressure-tank liquid level sensor 80 are both off.

During the ink circulation, the ink is fed from the positive pressure tank 61 to the line head 21, and the ink which is not consumed at the line head 21 is collected into the negative pressure tank 64. When the state where the positive-pressure-tank liquid level sensor 77 is off and the negative-pressure-tank liquid level sensor 80 is on is reached, the liquid-level maintaining control is performed such that the ink pump 65 sends the ink from the negative pressure tank 64 into the positive pressure tank 61. Printing is performed while the ink is circulated in this manner.

Also, when the state where the positive-pressure-tank liquid level sensor 77 and the negative-pressure-tank liquid level sensor 80 are both off is reached as the ink is consumed and the amount of the circulated ink is decreased, the liquid-level maintaining control is performed such that the ink feed valve 87 is opened to feed ink into the negative pressure tank 64.

Even if the liquid-level maintaining control is performed as described above, the liquid levels inside the positive pressure tank 61 and the negative pressure tank 64 still slightly vary. For example, the liquid levels inside the positive pressure tank 61 and the negative pressure tank 64 vary due to the flow of the ink from the positive pressure tank 61 into the line head 21 and the return of the ink which is not consumed at the line head 21 into the negative pressure tank 64. Further, the liquid level inside the negative pressure tank 64 varies due to the feed of the ink from the ink cartridge 86. Furthermore, the liquid levels inside the positive pressure tank 61 and the negative pressure tank 64 vary due to the sending of the ink by the ink pump 65.

The variations in the liquid levels inside the positive pressure tank 61 and the negative pressure tank 64 cause variations in the pressure on the positive pressure side and the pressure on the negative pressure side. To address this, the CPU 151 drives the air pump 105 and opens and closes the positive-pressure-side pressure adjustment valve 95 and the negative-pressure-side pressure adjustment valve 102 as appropriate in accordance with the detection values of the positive-pressure-side pressure sensor 97 and the negative-pressure-side pressure sensor 104 such that the pressure on the positive pressure side and the pressure on the negative pressure side are maintained at the preset pressures Pk, Pf.

When the printing finishes for all the pages of the print job, the CPU 151 stops the belt motor 16, the print-medium attracting fan 17, the blowing fan 57, and the sucking fan 59. Also, the CPU 151 opens the positive-pressure-side atmosphere release valve 93 and the negative-pressure-side atmosphere release valve 100. By this step, the printing operation ends and the inkjet printer 1 shifts to a standby state.

Next, the precursor drive control during the printing operation will be described.

Figure 16:
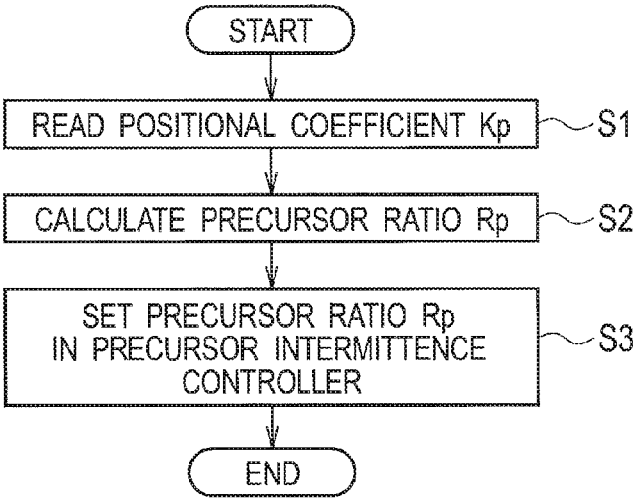
FIG. 16 is a flowchart of a precursor-ratio setting process in the first embodiment.

First, a precursor-ratio setting process in the precursor drive control will be described. FIG. 16 is a flowchart of the precursor-ratio setting process in the first embodiment.

In Step S1 in FIG. 16, the CPU 151 of the actuator controller 124 reads the positional coefficient Kp of each inkjet head 26 from the ROM 152. The positional coefficient Kp is a coefficient for calculating the precursor ratio Rp corresponding to the position of the inkjet head 26 relative to the head cooler 4. The positional coefficient Kp is stored in advance in the ROM 152 of the actuator controller 124.

Figure 17:
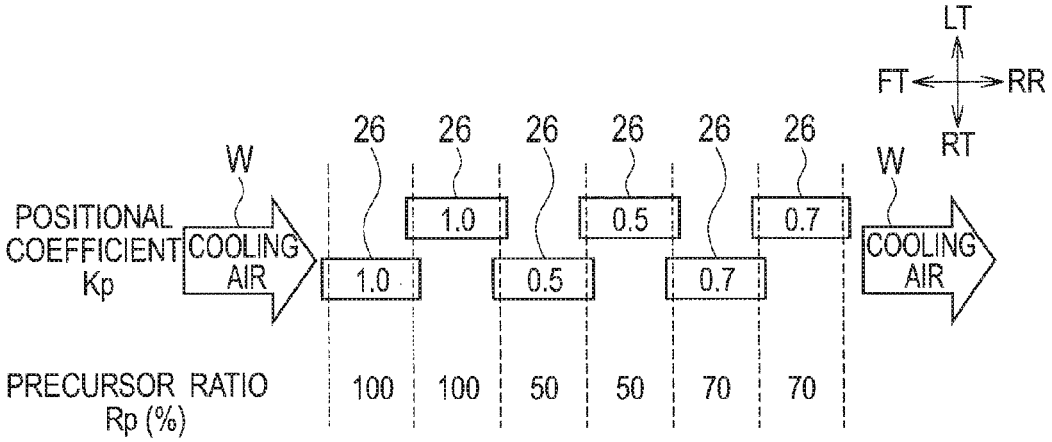
FIG. 17 is a diagram illustrating example values of a precursor ratio in the first embodiment.

The value of the positional coefficient Kp is greater for those inkjet heads 26 at positions at which they can be cooled more the head cooler 4. For example, as illustrated in FIG. 17, the positional coefficients Kp of the two front inkjet heads 26 close to the blower 51 are the greatest. The positional coefficients Kp of the two rear inkjet heads 26 close to the sucker 52 are the second greatest. The positional coefficients Kp of the two middle inkjet heads in the front-rear direction are the smallest.

Then, in Step S2, the CPU 151 calculates the precursor ratio Rp. The precursor ratio Rp is calculated from Equation (1) below.

$$Rp(\%)=Kp\times 100 \quad (1)$$

Then, in Step S3, the CPU 151 sets each precursor ratio Rp in the precursor intermittence controller 144 of the corresponding head drive controller 136. By this step, the precursor-ratio setting process ends.

Figure 18:
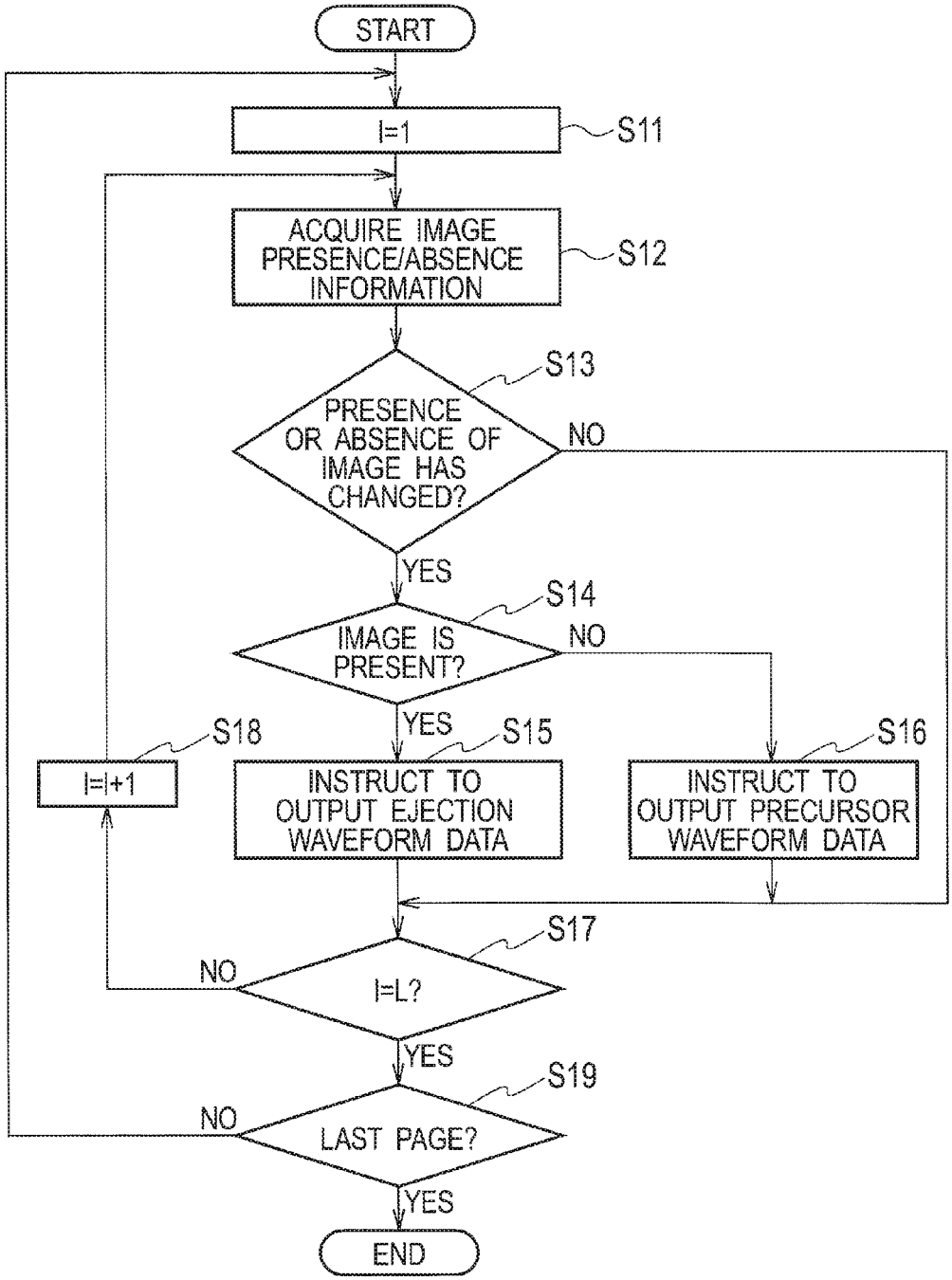
FIG. 18 is a flowchart of a waveform selecting process.

Next, a waveform selecting process in the precursor drive control will be described. FIG. 18 is a flowchart of the waveform selecting process.

In Step S11 in FIG. 18, the waveform selector 145 sets "1" to a variable 1 which indicates a line sequential number in the image data.

Then, in Step S12, the waveform selector 145 acquires the image presence/absence information on the l-th line from the image presence/absence determiner 142.

Then, in Step S13, based on the image presence/absence information, the waveform selector 145 determines whether or not the presence or absence of an image on the l-th line has changed from the presence or absence of an image on the (l−1)-th line. Note that in a case where l=1, the waveform selector 145 determines whether or not the presence or absence of an image on the l-th line has changed from the presence or absence of an image on the last line of the preceding page. The waveform selector 145 proceeds to Step S17 if determining that the presence or absence of image has not changed (Step S13: NO).

If determining that the presence or absence of an image has changed (Step S13: YES), the waveform selector 145 determines in Step S14 whether or not whether or not an image is present on the l-th line.

If determining that an image is present on the l-th line (Step S14: YES), the waveform selector 145 sends an instruction in Step S15 to the waveform setter 146 to select the ejection waveform as the drive waveform and output ejection waveform data to the inkjet head 26. After this, the waveform selector 145 proceeds to Step S17.

If determining in Step S14 that no image is present on the l-th line (Step S14: NO), the waveform selector 145 sends an instruction in Step S16 to the waveform setter 146 to select the precursor waveform as the drive waveform and output precursor waveform data to the inkjet head 26. After this, the waveform selector 145 proceeds to Step S17.

In Step S17, the waveform selector 145 determines whether or not the variable l is "L" which indicates the last line of the page. If determining that l≠L (Step S17: NO), the waveform selector 145 adds "1" to the variable l in Step S18. After this, the waveform selector 145 returns to Step S12.

If determining in Step S17 that l=L (Step 317: YES), the waveform selector 145 determines in Step S19 whether or not the currently printed page is the last page in the print job.

If determining that the currently printed page is not the last page (Step S19: NO), the waveform selector 145 returns to Step S11. If determining that the currently printed page is the last page (Step S19: YES), the waveform selector 145 ends the waveform selecting process.

Figure 19:
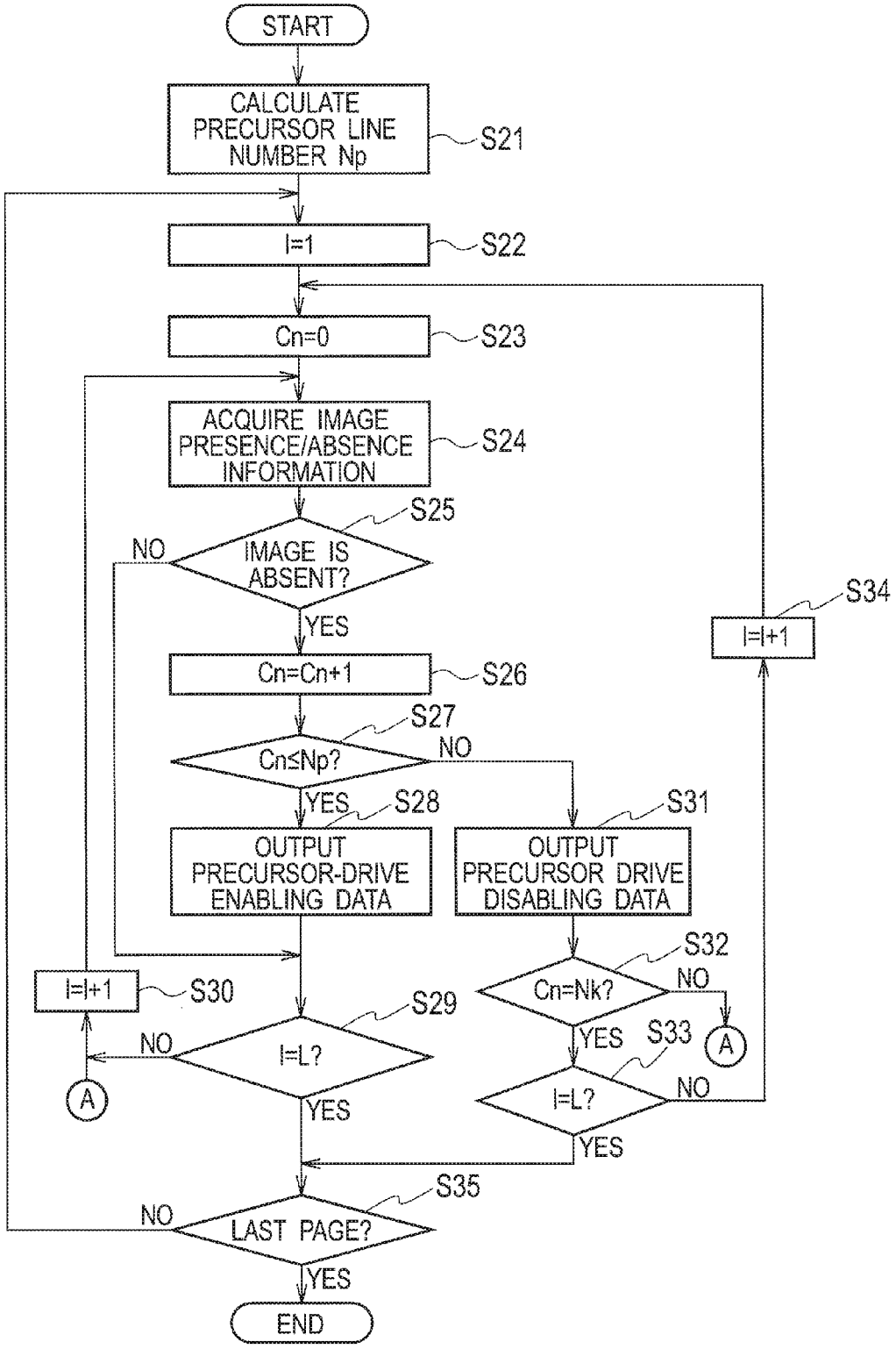
FIG. 19 is a flowchart of a precursor executing process.

Next, a precursor executing process in the precursor drive control will be described. FIG. 19 is a flowchart of the precursor executing process.

In Step S21 in FIG. 19, the precursor intermittence controller 144 calculates a precursor line number Np by using the precursor ratio Rp, which is set by the precursor-ratio setting process described above. The precursor line number Np is the number of lines on which to perform the precursor drive within a specified non-election line number Nk. The precursor line number Np is calculated from Equation (2) below.

$$Np=Nk\times Rp/100 \quad (2)$$

The specified non-ejection line number Nk is a unit number of lines for applying the precursor ratio Rp among lines which involve no ink ejection (contain no image). For example, if the specified non-ejection line number Nk=100 as in the case of FIG. 17, the value of the precursor ratio Rp is equal to the precursor line number Np.

Then, in Step S22, the precursor intermittence controller 144 sets "1" to the variable l, which indicates the line sequential number in the image data Then, in Step S23, the precursor intermittence controller 144 sets "0" to a count value Cn representing the number of lines which contain no image.

Then, in Step S24, the precursor intermittence controller 144 acquires the image presence/absence information on the l-th line from the image presence/absence determiner 142.

Then, in Step S25, based on the image presence/absence information, the precursor intermittence controller 144 determines whether or not an image is absent on the l-th line.

If determining that an image is absent on the l-th line (Step S25: YES), the precursor intermittence controller 144 adds "1" to the count value Cn in Step S26.

Then, in Step S27, the precursor intermittence controller 144 determines whether or not the count value Cn is smaller than or equal to the precursor line number Np.

If determining that Cn≤Np (Step S27: YES), the precursor intermittence controller 144 outputs precursor-drive enabling data to the inkjet head 26 in Step S28. The precursor-drive enabling data is data that enables the precursor drive on each ink chamber 27 of the inkjet head 26 a predetermined number of times during its drive period. The number of times the precursor drive is enabled during the drive period may be any number as long as it is smaller than or equal to the maximum number of droplets.

Then, in Step S29, the precursor intermittence controller 144 determines whether or not the variable l is "L," which indicates the last line of the page. The precursor intermittence controller 144 proceeds to Step S35 if determining that l=L (Step S29: YES).

If determining that l≠L (Step S29: NO), the precursor intermittence controller 144 adds "1" to the variable l in Step S30. After this, the precursor intermittence controller 144 returns to Step S24.

If determining in Step S25 that an image is present on the l-th line (Step S25: NO), the precursor intermittence controller 144 skips Steps S26 to S28 and proceeds to Step S29.

If determining in Step S27 that Cn>Np (Step S27: NO), the precursor intermittence controller 144 outputs precursor drive disabling data to the inkjet head 26 in Step S31. The non-precursor drive disabling data is data that disables the driving of each ink chamber 27 of the inkjet head 26.

Then, in Step S32, the precursor intermittence controller 144 determines whether or not the count value Cn has reached the specified non-ejection line number Nk. The precursor intermittence controller 144 proceeds to Step S30 if determining that Cn≠Nk (Step S32: NO).

If determining that Cn=Nk (Step S32: YES), the precursor intermittence controller 144 determines in Step S33 whether or not l=L. The precursor intermittence controller 144 proceeds to Step S35 if determining that l=L (Step S33: YES).

If determining that l≠L (Step S33: NO), the precursor intermittence controller 144 adds "1" to the variable l in Step S34. After this, the precursor intermittence controller 144 returns to Step S23.

In Step S35, the precursor intermittence controller 144 determines whether or not the currently printed page is the last page in the print job.

If determining that the currently printed page is not the last page (Step S35: NO), the precursor intermittence controller 144 returns to Step S22. If determining that the currently printed page is the last page (Step S35: YES), the precursor intermittence controller 144 ends the precursor executing process.

Figure 20:
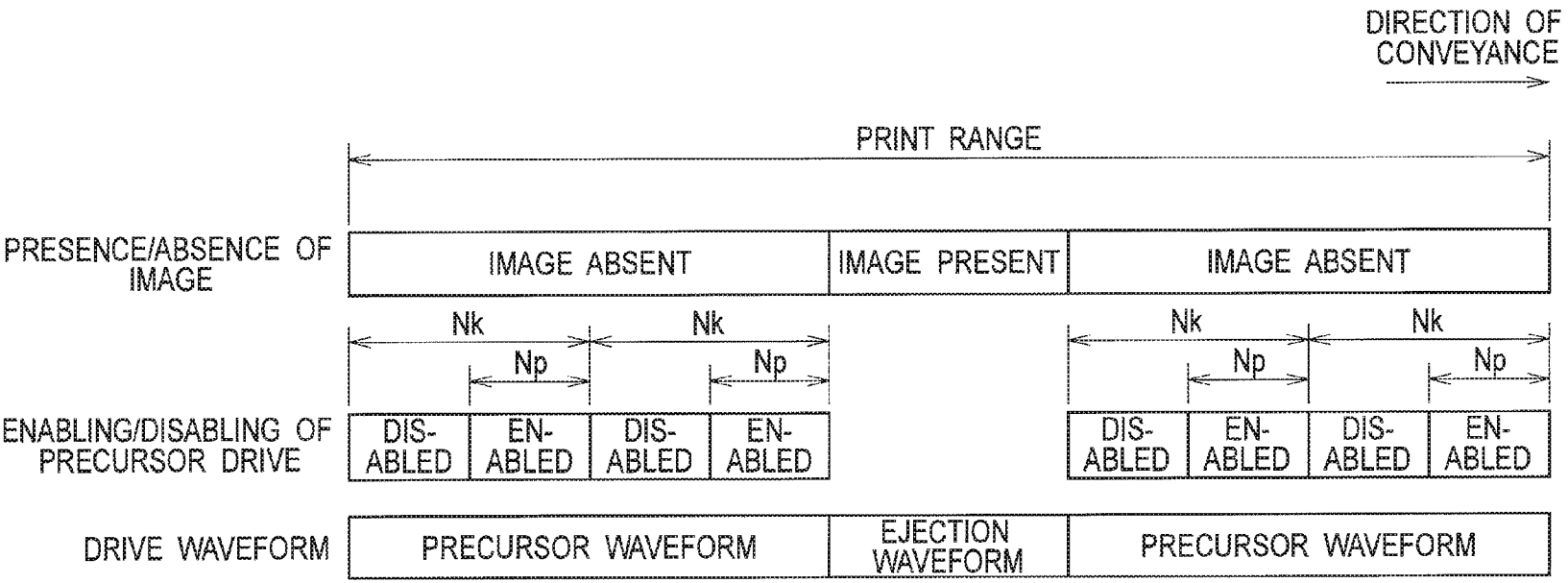
FIG. 20 is a diagram for describing waveform setting by the waveform selecting process and precursor drive by the precursor executing process.

The waveform setting and the precursor drive are performed as illustrated in FIG. 20 by the waveform selecting process and the precursor executing process described above. FIG. 20 schematically illustrates an example of the waveform setting and the precursor drive in each of an area containing an image and areas containing no image within the print range of one inkjet head 26.

As illustrated in FIG. 20, by the waveform selecting process described above, the precursor waveform is set as the drive waveform of the inkjet head 26 at drive timings for the lines containing no image.

Also, as illustrated in FIG. 20, by the precursor executing process, for each specified non-ejection line number Nk (specified number) of lines which involve no ink ejection (contain no image), the precursor drive is performed on the precursor line number Np of lines corresponding to the precursor ratio Rp.

As described above, in the inkjet printer 1, the controller 9 determines the precursor ratio Rp for each inkjet head 26 in accordance with the position of the inkjet head 26. In this way, the inkjet head 26 can be prevented from being excessively cooled, and the ink temperature can therefore be prevented from excessively decreased. As a result, the inkjet printer 1 can reduce the ink mist.

Also, for each specified non-ejection line number Nk of lines which involve no ink ejection, the controller 9 performs the precursor drive on the precursor line number Np of lines. In this way, the lines on which to perform the precursor drive can be spread. As a result, the decrease in temperature of the inkjet head 26 can be further suppressed, and the ink mist can therefore be further reduced.

Second Embodiment

Next, description will be given of a second embodiment which involves a change in the precursor-ratio setting process in the embodiment described above.

In the second embodiment, an image processor 122 is configured to calculate a print coverage rate Ra for each inkjet head 26 page by page based on image data.

Figure 21:
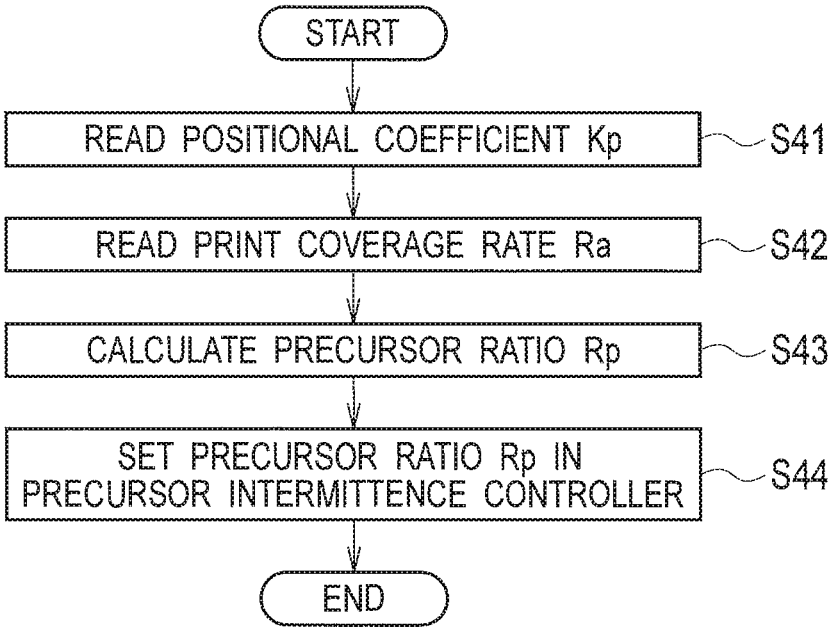
FIG. 21 is a flowchart of a precursor-ratio setting process in a second embodiment.

A CPU 151 of an actuator controller 124 is configured to calculate a precursor ratio Rp by using the print coverage rate Ra in a precursor-ratio setting process. FIG. 21 is a flowchart of the precursor-ratio setting process in the second embodiment.

In Step S41 in FIG. 21, the CPU 151 reads a positional coefficient Kp of each inkjet head 26 from a ROM 152.

Then, in Step S42, the CPU 151 reads the print coverage rate Ra of each inkjet head 26 from the image processor 122.

Then, Step S43, the CPU 151 calculates the precursor ratio Rp. In the second embodiment, the precursor ratio Rp is calculated from Equation (3) below.

$$Rp(\%)=Kp\times(100-Ra) \quad (3)$$

Figure 22:
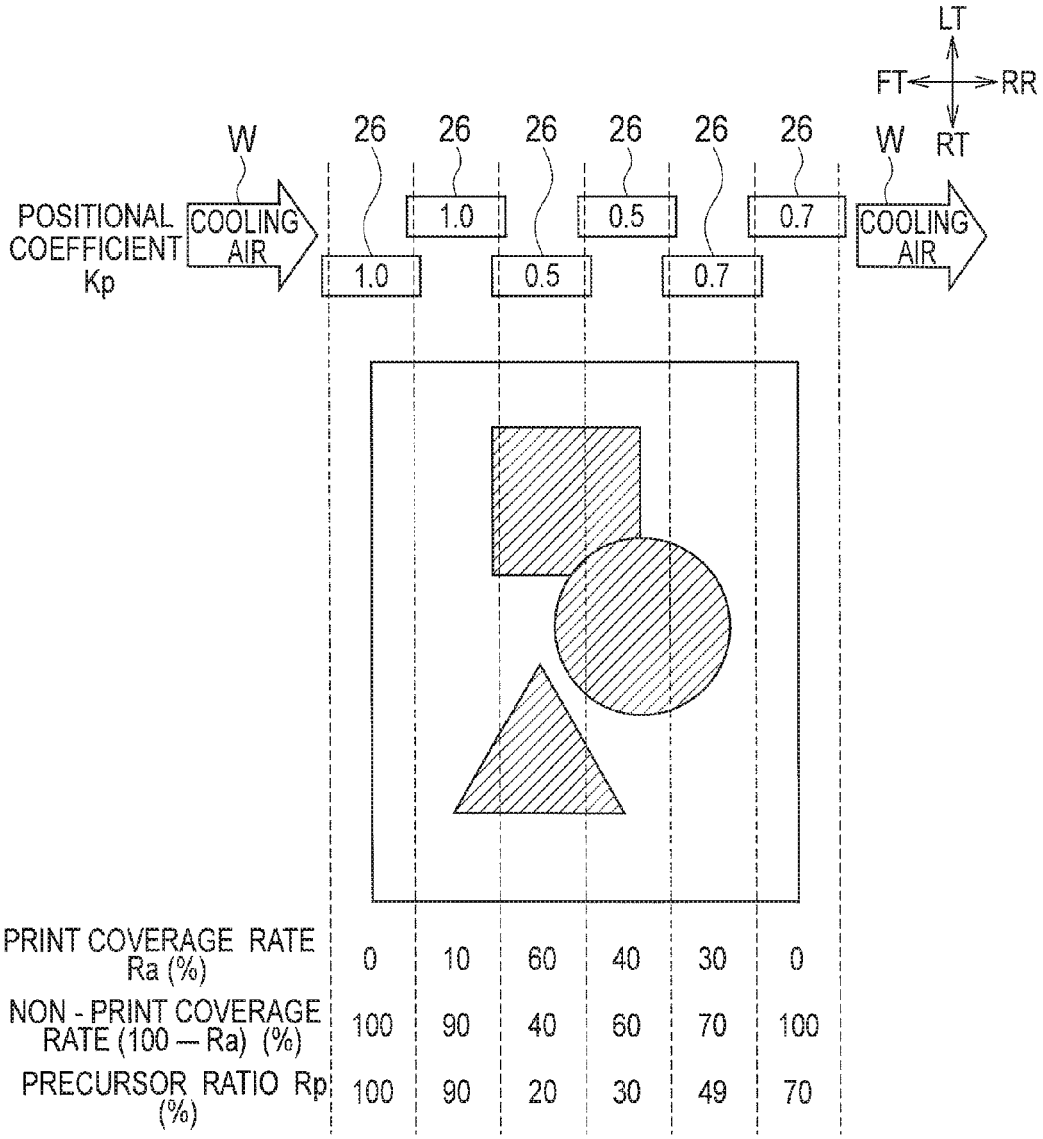
FIG. 22 is a diagram illustrating example values of a precursor ratio in the second embodiment.

As a result, as illustrated in FIG. 22, the precursor ratio Rp corresponding to the positional coefficient Kp and the print coverage rate Ra is calculated for each inkjet head 26.

Referring back to FIG. 21, in Step S44 after Step S43, the CPU 151 sets each precursor ratio in a precursor intermittence controller 144 of a corresponding head drive controller 136. By this step, the precursor-ratio setting process ends. The CPU 151 performs this precursor-ratio setting process page by page.

Since the precursor-ratio setting process is performed page by page, a precursor line number Np corresponding to the precursor ratio Rp is calculated page by page. Besides this feature, the precursor executing process in the second embodiment is similar to the precursor executing process in the first embodiment described above.

As described above, in the second embodiment, the precursor ratio Rp is adjusted based on the print coverage rate Ra, which affects the temperature of the inkjet head 26. In this way, the temperature of the inkjet head 26 can be maintained at more appropriate temperature, and the ink mist can therefore be further reduced.

Third Embodiment

Next, description will be given of a third embodiment which involves a change in the precursor-ratio setting process in the embodiments described above.

Figure 23:
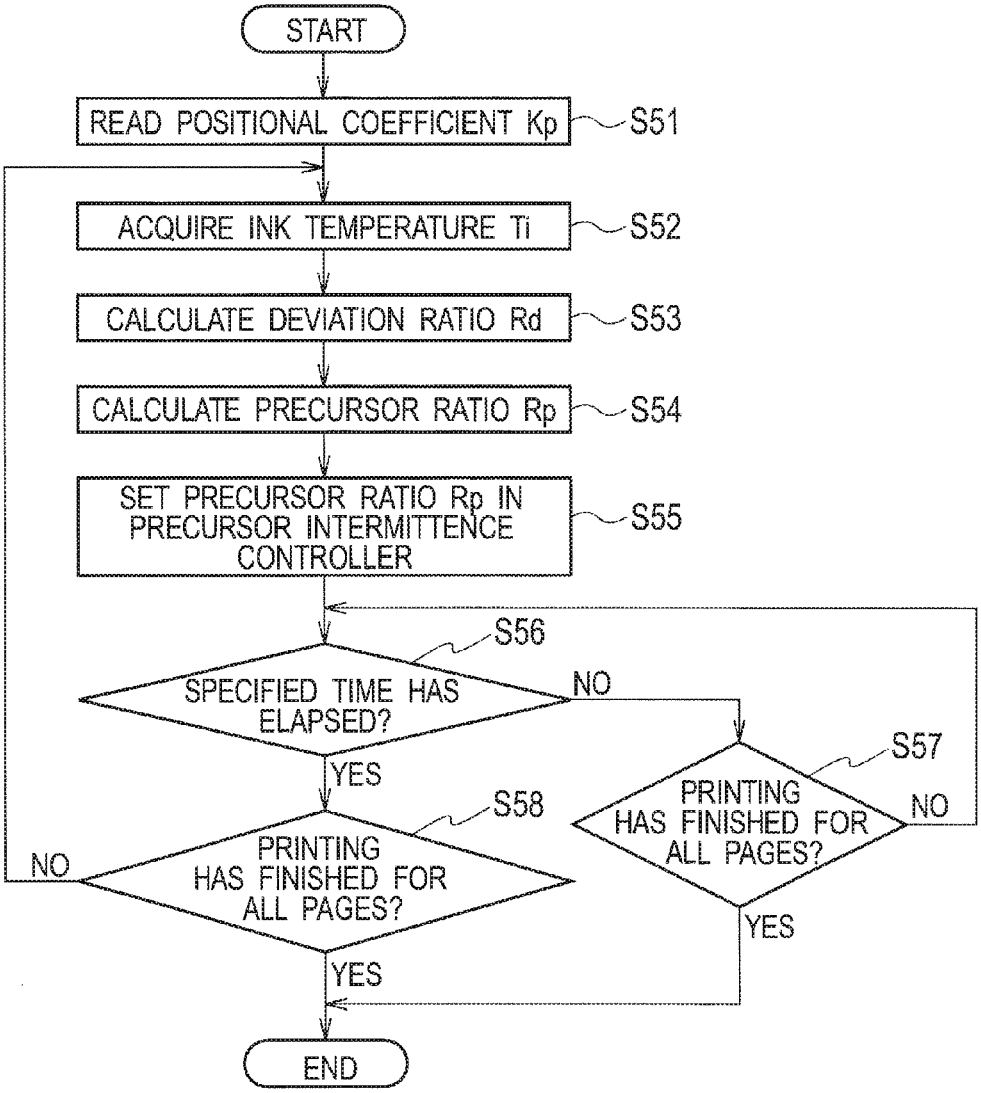
FIG. 23 is a flowchart of a precursor-ratio setting process in a third embodiment.

FIG. 23 is a flowchart of a precursor-ratio setting process in the third embodiment.

In Step S51 in FIG. 23, a CPU 151 of an actuator controller 124 reads a positional coefficient Kp of each inkjet head 26 from a ROM 152.

Then, in Step S52, the CPU 151 acquires an ink temperature Ti at the inkjet head 26 from its head-ink temperature sensor 68.

Then, in Step S53, the CPU 151 calculates a deviation ratio Rd of the ink temperature Ti from a reference temperature Tk. The deviation ratio Rd is calculated from Equation (4) below.

$$Rd(\%)=((Tk-Ti)/Tk)\times 100 \quad (4)$$

Then, in Step S54, the CPU 151 calculates a precursor ratio Rp. In the third embodiment, the precursor ratio Rp is calculated from Equation (5) below.

$$Rp(\%)=Kp\times Rd \quad (5)$$

Figure 24:
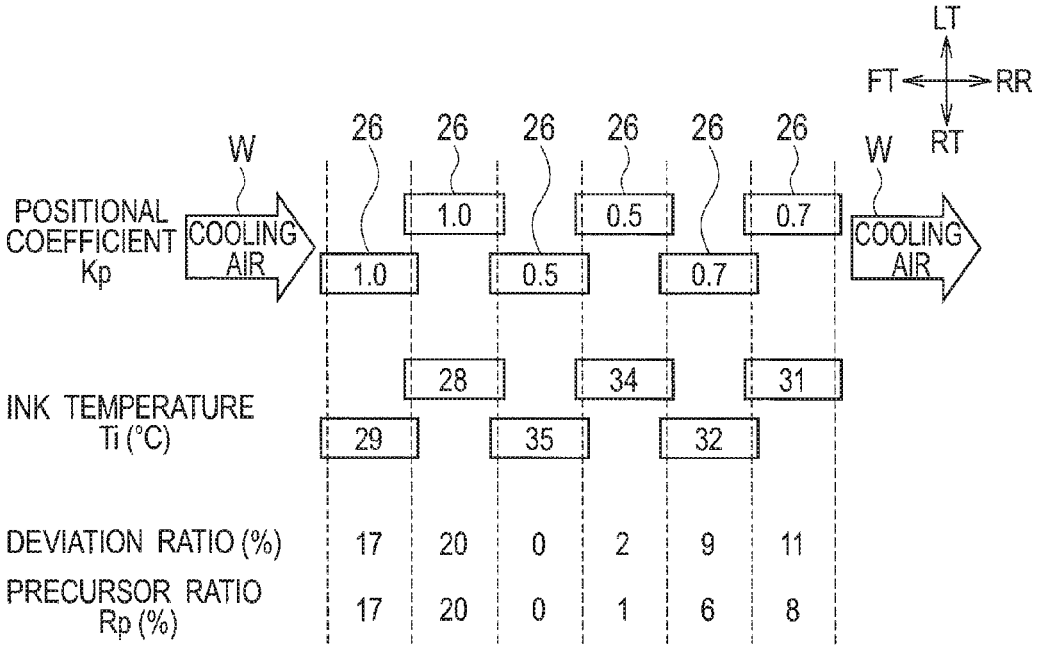
FIG. 24 is a diagram illustrating example values of a precursor ratio in the third embodiment.

As a result, as illustrated in FIG. 24, the precursor ratio Rp corresponding to the positional coefficient Kp and the ink temperature Ti is calculated for each inkjet head 26. Note that FIG. 24 illustrates an example where the reference temperature Tk is 35° C.

Referring back to FIG. 23, Step S55 after Step S54, the CPU 151 sets each precursor ratio lip in a precursor intermittence controller 144 of a corresponding head drive controller 136.

Then, in Step S56, the CPU 151 determines whether or not a specified time has elapsed since the setting of the last precursor ratio Rp.

If determining at the specified time has not elapsed (Step S56: NO), the CPU 151 determines in Step S57 whether or not the print has finished for all the pages in the print job.

If determining the printing has not finished for all the pages (Step S57: NO), the CPU 151 returns to Step S56. If determining that the printing has finished for all the pages (Step S57: YES), the CPU 151 ends the precursor-ratio setting process.

If determining in Step S56 that the specified time has elapsed (Step S56: YES), the CPU 151 determines in Step S58 whether or not the printing has finished for all the pages in the print job. If determining that the printing has not finished for all the pages (Step S58: NO), the CPU 151 returns to Step S52 to acquire the ink temperature Ti and repeats the subsequent processing. If determining that the printing has finished for all the pages (Step S58: YES), the CPU 151 ends the precursor-ratio setting process.

A precursor executing process in the third embodiment is similar to the precursor executing process in the first embodiment described above. However, since the precursor ratio Rp is calculated and set every specified time, a precursor line number Np is changed accordingly.

As described above, in the third embodiment, the precursor ratio Rp is adjusted based on the_ink temperature Ti at the inkjet head 26. In this way, the temperature of the inkjet head 26 can be maintained at more appropriate temperature, and the ink mist can therefore be further reduced.

Fourth Embodiment

Next, description will be given of a fourth embodiment which involves a change in the precursor-ratio setting process in the embodiments described above.

In the fourth embodiment, a head-medium-distance-based adjustment value Kh is stored in advance for each type of print medium in a ROM 152 of an actuator controller 124. The head-medium-distance-based adjustment value Kh is a value for adjusting a precursor ratio Rp in accordance with a head-medium distance Hp. The head-medium distance Hp is the distance between an ink ejection surface 26*a* and the upper surface of a print medium P on a conveyance surface 11*b*. In other words, the head-medium distance Hp is a value obtained by subtracting the thickness of the print medium P from a head gap Hg. The head-medium distance Hp differs depending on the type of print medium.

Figure 25:
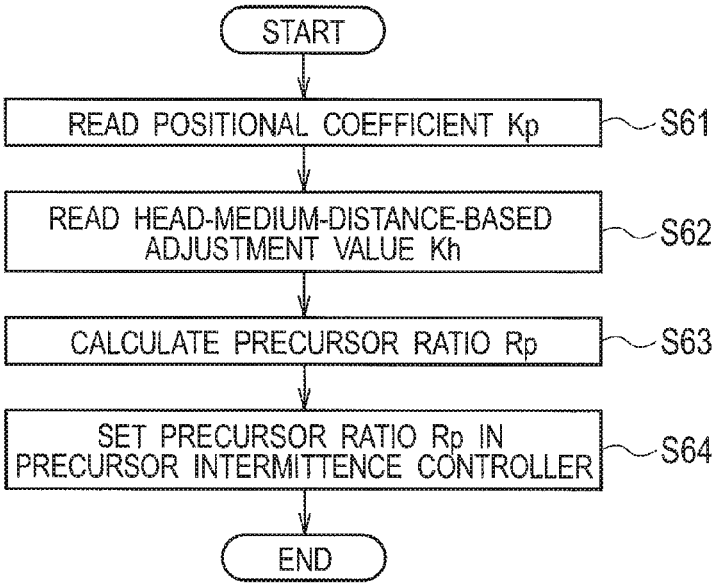
FIG. 25 is a flowchart of a precursor-ratio setting process in a fourth embodiment.

The larger the head-medium distance Hp is, the longer the flying time of the ink is and therefore the more the ink mist tends to be generated. For this reason, in the fourth embodiment, the precursor ratio Rp is calculated by using the head-medium-distance-based adjustment value Kh. FIG. 25 is a flowchart of a precursor-ratio setting process in the fourth embodiment.

In Step S61 in FIG. 25, a CPU 151 of the actuator controller 124 reads a positional coefficient Kp of each inkjet head 26 from the ROM 152.

Then, in Step S62, the CPU 151 reads the head-medium-distance-based adjustment value Kh corresponding to the type of the print medium used from the ROM 152.

Then, in Step S63, the CPU 151 calculates the precursor ratio Rp. In the fourth embodiment, the precursor ratio Rp is calculated from Equation (6) below.

$$Rp(\%)=(Kp+Kh)\times 100 \quad (6)$$

Figure 26:
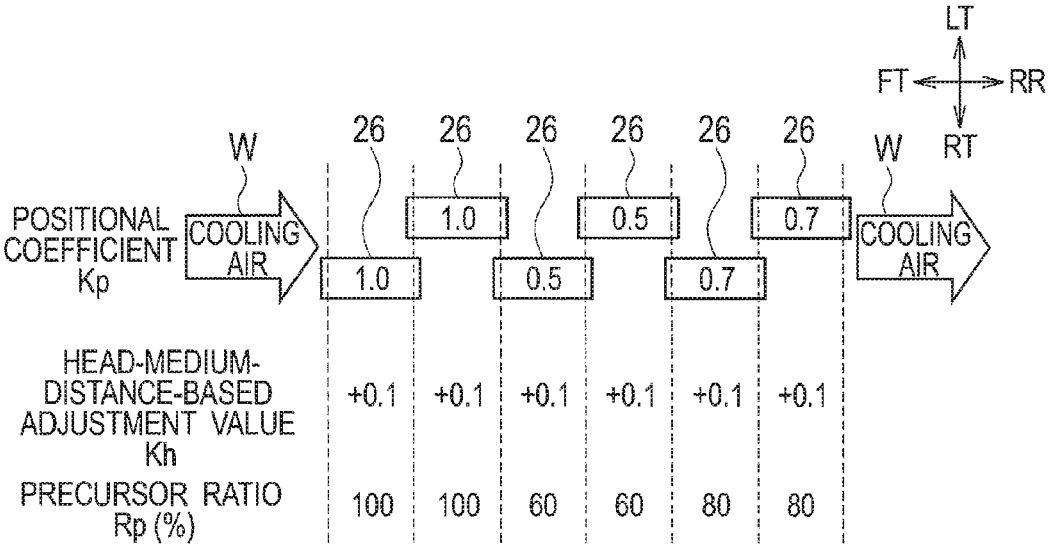
FIG. 26 is a diagram illustrating example values of a precursor ratio in the fourth embodiment.

As a result, as illustrated in FIG. 26, the precursor ratio Rp corresponding to the positional coefficient Kp and the head-medium-distance-based adjustment value Kh is calculated for each inkjet head 26. Here, the precursor ratio Rp is set to 100% in a case where the value of Rp calculated from Equation (6) is greater than 100%.

Referring back to FIG. 25, in Step S64 after Step S63, the CPU 151 sets each precursor ratio Rp in a precursor intermittence controller 144 of a corresponding head drive controller 136. By this step, the precursor-ratio setting process ends.

A precursor executing process in the fourth embodiment is similar to the precursor executing process in the first embodiment described above.

As described above, in the fourth embodiment, the precursor ratio Rp is adjusted based on the head-medium distance Hp, which affects the degree of generation of the ink mist. In this way, the ink mist can be further reduced.

Fifth Embodiment

Next, description will be given of a fifth embodiment which involves a change in the precursor-ratio setting process in the embodiments described above.

In the fifth embodiment, a medium-end-portion adjustment value Ke is stored in advance in a ROM 152 of an actuator controller 124. The medium-end-portion adjustment value Ke is a value for adjusting a precursor ratio Rp for each of inkjet heads 26 at positions coinciding with end portions of a print medium P in the main scanning direction (front-rear direction), which is a direction perpendicular to the direction of conveyance.

Figure 27:
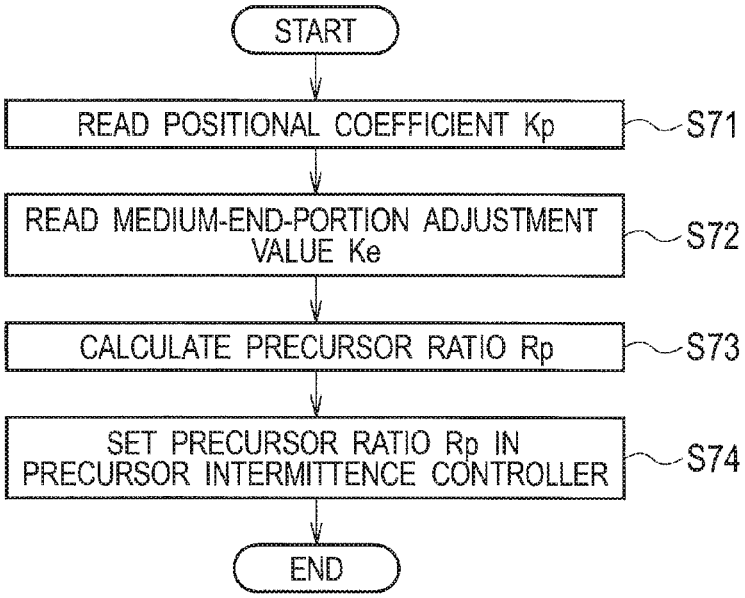
FIG. 27 is a flowchart of a precursor-ratio setting process in a fifth embodiment.

In the case of an air suction-type conveyer 2, the air suction through belt holes ha generates airflows directed outward of the print medium P at the end portions of the print medium P. Due to these airflows, the ink mist tends to be generated more at the end portions of the print medium P. For this reason, in the fifth embodiment, the medium-end-portion adjustment value Ke is used for the calculation of the precursor ratio Rp. FIG. 27 is a flowchart of a precursor-ratio setting process in the fifth embodiment.

In Step S71 in FIG. 27, a CPU 151 of the actuator controller 124 reads a positional coefficient Kp of each inkjet head 26 from the ROM 152.

Then, in Step S72, the CPU 151 reads the medium-end-portion adjustment value Ke from the ROM 152.

Then, in Step S73, the CPU 151 calculates the precursor ratio Rp. Here, the precursor ratio Rp is calculated from Equation (7) below for the inkjet heads 26 at the positions coinciding with the end portions of the print medium P in the main scanning direction (front-rear direction). The precursor ratio Rp is calculated from Equation (1) mentioned earlier for the rest of the inkjet heads 26.

$$Rp(\%)=(Kp+Ke)\times 100 \quad (7)$$

Figure 28:
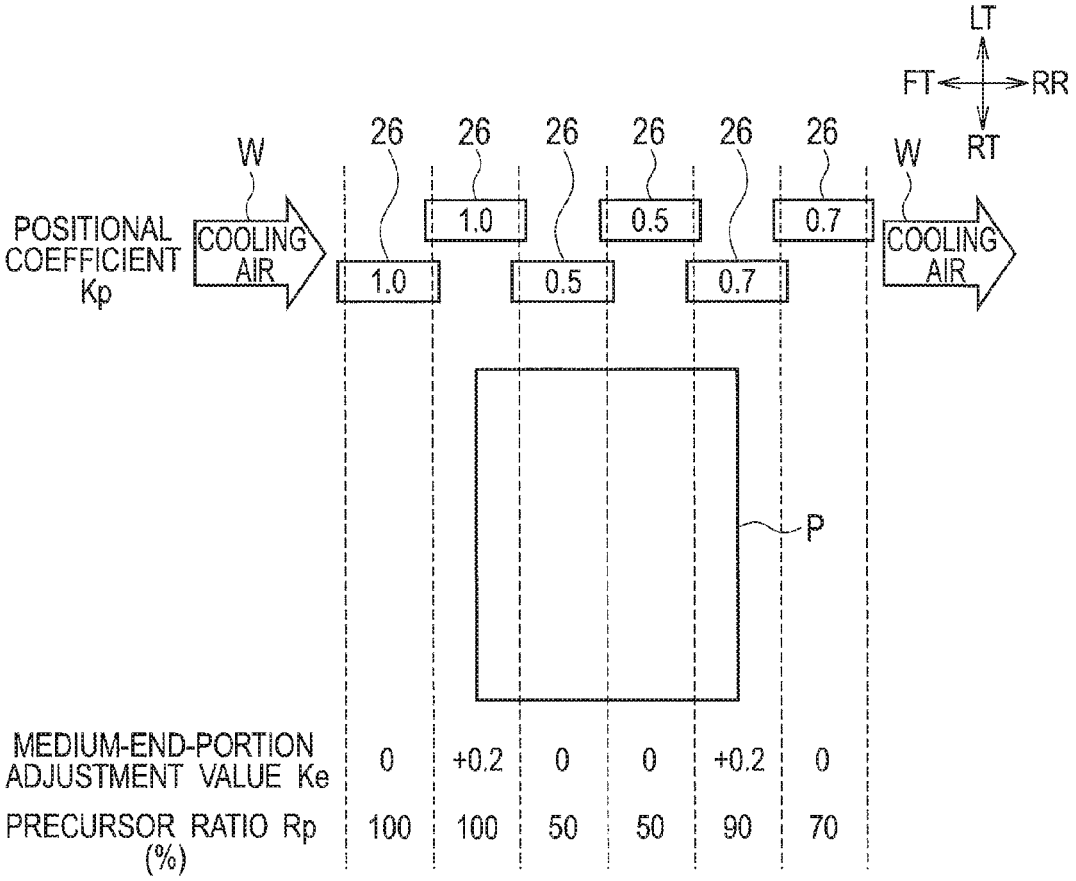
FIG. 28 is a diagram illustrating example values of a precursor ratio in the fifth embodiment.

As a result, as illustrated in FIG. 28, the precursor ratio Rp corresponding to the positional coefficient Kp and the medium-end-portion adjustment value Ke is calculated for the inkjet heads 26 at the positions coinciding with the end portions of the print medium P in the main scanning direction (front-rear direction). Here, the precursor ratio Rp is set to 100% in the case where the value of Rp calculated from Equation (7) is greater than 100%.

Referring back to FIG. 27, in Step S74 after Step S73, the CPU 151 sets each precursor ratio Rp in a precursor intermittence controller 144 of a corresponding head drive controller 136. By this step, the precursor-ratio setting process ends.

A precursor executing process in the fifth embodiment is similar to the precursor executing process in the first embodiment described above.

As described above, in the fifth embodiment, the precursor ratio Rp is adjusted for each of the inkjet heads 26 at the positions coinciding with the end portions of the print medium P in the main scanning direction, at which the ink mist tends to be generated more. In this way, the ink mist can be further reduced.

Other Embodiments

The precursor-ratio setting process in the fourth embodiment may be combined with the precursor-ratio setting process in the second embodiment or the third embodiment. Alternatively, the precursor-ratio setting process in the fifth embodiment may be combined with the precursor-ratio setting processes in the second to fourth embodiments.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer, comprising:

a conveyer configured to convey a print medium;

a plurality of inkjet heads configured to perform ink ejection per line of an image onto the print medium conveyed by the conveyer;

a head cooler configured to generate cooling air and cool the plurality of inkjet heads by the generated cooling air; and a controller configured to drive the plurality of inkjet heads to perform non-ejection drive on at least one of lines which involve no ink ejection, the non-ejection drive being driving of the plurality of inkjet heads to such a degree as to eject no ink, wherein the controller is configured to determine a non-ejection drive ratio for each of the plurality of inkjet heads in accordance with a position of each of the plurality of inkjet heads to control a degree of cooling of each inkjet head by the head cooler, the non-ejection drive ratio being a ratio of lines on which the controller performs the non-ejection drive to the lines which involve no ink ejection.

2. The inkjet printer according to claim 1, wherein the controller is configured to drive the plurality of inkjet heads to perform, for each first number of lines which involve no ink ejection, the non-ejection drive on a second number of lines of the first number of lines, the second number corresponding to the determined non-ejection drive ratio.

3. The inkjet printer according to claim 1, wherein the controller is configured to adjust the non-ejection drive ratio based on a print coverage rate at each of the plurality of inkjet heads.

4. The inkjet printer according to claim 2, wherein the controller is configured to adjust the non-ejection drive ratio based on a print coverage rate at each of the plurality of inkjet heads.

5. The inkjet printer according to claim 1, wherein the controller is configured to adjust the non-ejection drive ratio based on an ink temperature at each of the plurality of inkjet heads.

6. The inkjet printer according to claim 2, wherein the controller is configured to adjust the non-ejection drive ratio based on an ink temperature at each of the plurality of inkjet heads.

7. The inkjet printer according to claim 1, wherein the controller is configured to adjust the non-ejection drive ratio based on a distance between an upper surface of the print medium and an ink ejection surface of each of the plurality of inkjet heads.

8. The inkjet printer according to claim 2, wherein the controller is configured to adjust the non-ejection drive ratio based on a distance between an upper surface of the print medium and an ink ejection surface of each of the plurality of inkjet heads.

9. The inkjet printer according to claim 3, wherein the controller is configured to adjust the non-ejection drive ratio based on a distance between an upper surface of the print medium and an ink ejection surface of each of the plurality of inkjet heads.

10. The inkjet printer according to claim 5, wherein the controller is configured to adjust the non-ejection drive ratio based on a distance between an upper surface of the print medium and an ink ejection surface of each of the plurality of inkjet heads.

11. The inkjet printer according to claim 1, wherein the conveyer is configured to convey the print medium while attracting and holding the print medium by air suction, and the controller is configured to adjust the non-ejection drive ratio for one of the plurality of inkjet heads located at a position coinciding with an end portion of the print medium in a direction perpendicular to a direction of conveyance of the print medium by the conveyer.

12. The inkjet printer according to claim 2, wherein the conveyer is configured to convey the print medium while attracting and holding the print medium by air suction, and the controller is configured to adjust the non-ejection drive ratio for one of the plurality of inkjet heads located at a position coinciding with an end portion of the print medium in a direction perpendicular to a direction of conveyance of the print medium by the conveyer.

13. The inkjet printer according to claim 3, wherein the conveyer is configured to convey the print medium while attracting and holding the print medium by air suction, and the controller is configured to adjust the non-ejection drive ratio for one of the plurality of inkjet heads located at a position coinciding with an end portion of the print medium in a direction perpendicular to a direction of conveyance of the print medium by the conveyer.

14. The inkjet printer according to claim 5, wherein the conveyer is configured to convey the print medium while attracting and holding the print medium by air suction, and the controller is configured to adjust the non-ejection drive ratio for one of the plurality of inkjet heads located at a position coinciding with an end portion of the print medium in a direction perpendicular to a direction of conveyance of the print medium by the conveyer.

15. The inkjet printer according to claim 7, wherein the conveyer is configured to convey the print medium while attracting and holding the print medium by air suction, and the controller is configured to adjust the non-ejection drive ratio for one of the plurality of inkjet heads located at a position coinciding with an end portion of the print medium in a direction perpendicular to a direction of conveyance of the print medium by the conveyer.

16. The inkjet printer according to claim 1, wherein the position of each of the plurality of inkjet heads is a position of each inkjet head relative to the head cooler.

* * * * *